US011834321B2

(12) United States Patent
Bach et al.

(10) Patent No.: US 11,834,321 B2
(45) Date of Patent: Dec. 5, 2023

(54) MONITORING OF A BEVERAGE DISPENSING SYSTEM

(71) Applicant: Carlsberg Breweries A/S, Copenhagen V (DK)

(72) Inventors: Peter Bach, Copenhagen V (DK); Roland Jonathan Koch, Berlin (DE); Luka Karoli, Berlin (DE)

(73) Assignee: CARLSBERG BREWERIES A/S, Copenhagen (DK)

( * ) Notice: Subject to any disclaimer, the term of this patent is extended or adjusted under 35 U.S.C. 154(b) by 0 days.

(21) Appl. No.: 17/428,513

(22) PCT Filed: Feb. 12, 2020

(86) PCT No.: PCT/EP2020/053640
§ 371 (c)(1),
(2) Date: Aug. 4, 2021

(87) PCT Pub. No.: WO2020/165277
PCT Pub. Date: Aug. 20, 2020

(65) Prior Publication Data

US 2022/0144616 A1 May 12, 2022

(30) Foreign Application Priority Data

Feb. 12, 2019 (EP) ..... 19156738

(51) Int. Cl.
*B67D 1/04* (2006.01)
*B67D 1/08* (2006.01)
*B67D 1/12* (2006.01)

(52) U.S. Cl.
CPC ..... *B67D 1/0462* (2013.01); *B67D 1/0888* (2013.01); *B67D 1/1243* (2013.01);
(Continued)

(58) Field of Classification Search
CPC ..... B67D 1/04–0462; B67D 2001/0828
See application file for complete search history.

(56) References Cited

U.S. PATENT DOCUMENTS 5,454,406 A * 10/1995 Rejret ..... B67D 1/1213 141/83
5,511,694 A * 4/1996 Rohm ..... B67D 1/1234 222/27

(Continued)

FOREIGN PATENT DOCUMENTS

WO 2004/050537 A2 6/2004
WO 2007/019848 A2 2/2007

(Continued)

OTHER PUBLICATIONS

International Search Report and Written Opinion for International Application No. PCT/EP2020/053640, entitled "Monitoring of a Beverage Dispensing System," consisting of 16 pages. dated Apr. 14, 2020.

*Primary Examiner* — Vishal Pancholi
*Assistant Examiner* — Randall A Gruby
(74) *Attorney, Agent, or Firm* — Hamilton, Brook, Smith & Reynolds, P.C.

(57) ABSTRACT

Beverage dispensing system (10) comprising: —one or more pressure chambers comprising a connectable base (14) part and lid (12) defining a sealed inner space (16) for accommodating and encapsulating a collapsible beverage container (18) having a beverage outlet connectable to the base part (14), —a tapping device (34) comprising one or more tapping heads (36) for extracting the beverage from the collapsible beverage container(s), —a tapping line (28) extending from said base part (14) to said tapping device, said tapping line comprising one or more beverage lines, and—at least one measuring device (56) configured for monitoring at least one physical quantity of the tapping line,
(Continued)

sealed inner space, base part, lid and/or collapsible beverage container, said measuring device configured to have a sampling rate of at least 10 Hz, wherein the beverage dispensing system is configured for—processing data from the measuring device, and—detecting an event in the system by continuously analysing data from the measuring device.

20 Claims, 12 Drawing Sheets

(52) U.S. Cl.
CPC .... *B67D 1/1247* (2013.01); *B67D 2001/0828* (2013.01); *B67D 2210/00091* (2013.01)

(56) References Cited

U.S. PATENT DOCUMENTS 5,730,323 A * 3/1998 Osborne ..... B67D 1/04 222/399
5,750,905 A * 5/1998 Weimer ..... B67D 1/08 222/14
5,909,825 A * 6/1999 Lydford ..... B67D 1/0871 116/110
5,950,870 A * 9/1999 Takenaka ..... B67D 1/12 222/640
7,096,617 B2 * 8/2006 Bydalek ..... B67D 1/0872 222/113
7,753,231 B2 * 7/2010 Giles ..... G01F 15/003 222/14
7,810,679 B2 * 10/2010 Wauters ..... B67D 1/0462 222/401
7,837,063 B2 * 11/2010 Stoddard ..... G01F 15/003 222/14
8,857,661 B2 * 10/2014 Maas ..... B65D 25/14 239/323
8,925,382 B1 * 1/2015 Beal ..... G01F 23/14 73/299
9,061,879 B2 * 6/2015 Patthey ..... B67D 7/08
9,242,845 B2 * 1/2016 Otto ..... B67D 1/0001
9,284,177 B2 * 3/2016 Litto ..... B67D 1/0878
9,399,541 B2 * 7/2016 Maas ..... B65D 25/14
9,731,954 B2 * 8/2017 Blackburn ..... B67D 1/0004
9,914,630 B2 * 3/2018 Takei ..... B67D 1/1416
10,301,160 B2 * 5/2019 Raguzin ..... B67D 1/0075
11,066,288 B2 * 7/2021 Christiansen ..... B67D 1/0462
2010/0059548 A1 * 3/2010 Smid ..... B67D 1/0885 222/394
2010/0096040 A1 4/2010 Litto
2011/0036451 A1 * 2/2011 Maas ..... B67D 1/0462 141/2
2012/0138161 A1 * 6/2012 Wolthers ..... B67D 1/0431 428/34.1
2013/0081443 A1 * 4/2013 Rasmussen ..... B67D 1/1247 222/61
2013/0292407 A1 11/2013 Beavis et al.
2022/0144616 A1 * 5/2022 Bach ..... B67D 1/0888
2022/0217989 A1 * 7/2022 Rubin ..... B67D 7/0216

FOREIGN PATENT DOCUMENTS

WO 2007019849 A2 2/2007
WO 2007019850 A2 2/2007
WO 2007019851 A1 2/2007
WO 2007019853 A2 2/2007
WO 2009024147 A2 2/2009
WO 2011002295 A1 1/2011
WO 2015040146 A1 3/2015
WO 2019110554 A1 6/2019
WO 2020165277 A1 8/2020

* cited by examiner

MONITORING OF A BEVERAGE DISPENSING SYSTEM

This application is the U.S. National Stage of International Application No. PCT/EP2020/053640, filed Feb. 12, 2020, which designates the U.S., published in English, and claims priority under 35 U.S.C. § 119 or 365(c) to European Application No. 19156738.7, filed Feb. 12, 2019. The entire teachings of the above applications are incorporated herein by reference.

The present disclosure relates to a beverage dispensing system and systems and methods for monitoring thereof, that can be used to automatically detect particular use of and actions in the system. In particular the present disclosure relates to automatic determination of the dispensed volume of beverage dispensed from the beverage dispense system and thereby also estimate the remaining contents of beverage in the system.

BACKGROUND OF INVENTION

Conventional beverage dispensing systems intended for professional or private use such as e.g. the DraughtMaster® system produced by the applicant company are described in e.g. WO 2007/019848, WO 2007/019849, WO 2007/019850, WO 2007/019851 and WO 2007/019853. These applications are hereby incorporated by reference in their entirety.

Such beverage dispensing systems are used to store and dispense mainly carbonated beverages such as beer, soda, sparkling water, sparkling wine, etc., but also other types of non-carbonated beverages, e.g. milk, coffee, water, juice, etc. In these systems, the beverage is stored in a single use collapsible container, which normally cannot be inspected visually after installation, e.g. due to a pressurised inner volume. Consequently, it is not known how much beverage remains in the beverage container at any given time after the first usage of the beverage system. An advantage of this kind of closed system is that it ensures a sustained high quality of the beverage product after opening, since the operator/manager cannot come in direct contact with the contents, and thus no bacteria or dirt can contaminate the beverage. A downside of the closed system, however, is that the remaining contents of the beverage container is not known at all times, which is inconvenient for the user, e.g. a bar manager or a host at a private party, since he/she does not know when it is time to change the beverage container. Hence, it is of interest to automatically monitor or survey one or more properties of the beverage dispensing system, preferably using a non-contact method such that direct contact with the beverage is avoided.

A bar typically serves a number of different beverages placed in separate beverage containers (e.g. kegs) at a remote location from the actual bar. Thus, it is of interest for the bar manager to survey the volume level of each individual beverage container, to ensure that a new keg is ordered in due time and to ensure that the keg is changed in time without the customer having to wait for a keg change. Additionally, it is of interest to know the amount of dispensed beverage during any given dispensing operation in order to survey what kind of beverage is favoured among customers and how much of a certain beverage is served in certain periods during the day and night. And finally it is of interest to monitor the status of the beverage dispensing system, e.g. with respect to malfunctioning.

SUMMARY OF INVENTION

It is a purpose of the present disclosure to provide technologies for the monitoring of a beverage dispensing system using an automatic and non-invasive method.

It is also purpose of the present disclosure to provide technologies for estimating the amount of dispensed beverage during a dispensing operation and the amount of beverage remaining in the collapsible beverage container, so that a minimum of beverage is wasted when an empty collapsible beverage container or an empty keg has to be replaced with a new collapsible beverage container or a new keg, respectively, while also minimising the amount of foam coming out of a tapping head.

In a general perspective the present disclosure therefore relates to a surveillance system for monitoring a beverage dispensing system comprising one or more pressure chambers, each pressure chamber configured for accommodating a collapsible beverage container in a sealed inner space. The surveillance system preferably comprises one or more measuring devices, e.g. in the form of sensors, for monitoring various properties of the beverage dispensing system.

The present disclosure also relates to a beverage dispensing system for dispensing a beverage wherein such a surveillance system can be integrated. The beverage dispensing system comprising:

- one or more pressure chambers comprising a connectable base part and lid defining a sealed inner space for accommodating and encapsulating a collapsible beverage container having a beverage outlet connectable to the base part,
- a tapping device comprising one or more tapping heads for extracting the beverage from the collapsible beverage container(s),
- a tapping line extending from said base part(s) to said tapping device, said tapping line comprising one or more beverage lines, and
- at least one measuring device for each pressure chamber configured for monitoring at least one property of the corresponding tapping line, sealed inner space, base part, lid and/or collapsible beverage container.

The present disclosure further relates to a method for monitoring a beverage dispensing system, said beverage dispensing system comprising one or more pressure chambers, each pressure chamber defining a sealed inner space for accommodating and encapsulating a collapsible beverage container, a tapping device comprising one or more tapping heads for extracting the beverage from the collapsible beverage container(s), and a tapping line extending from the pressure chamber(s) to said tapping device. In the preferred embodiment the method comprises the steps of measuring with a sampling rate of at least 10 Hz, preferably at least 50 Hz, at least one property of said pressure chamber, the corresponding sealed inner space, and/or the corresponding collapsible beverage container, continuously analysing data representing said measured property, and correlating a change, preferably a sub-second change, in said measured property to an action in the beverage dispensing system.

The measuring device(s) can for be configured for monitoring/measuring at least one physical quantity or property of the sealed inner space of the pressure chamber, a property such as temperature, pressure, humidity, sound, etc. The measuring device(s) can also be configured for monitoring at least one property and/or a physical quantity of the tapping line, the beverage line and/or the collapsible beverage container, e.g. pressure, sound, force, acceleration, etc. A physical quantity should be understood as a property of a material or system that can be quantified by measurement. A physical quantity may relate to the property of a gas, e.g. the pressure of a gas. The terms "property" and "physical quantity" may be understood to be interchangeable.

One purpose of the measuring device is to detect a change or an action in the beverage dispensing system. A typical and very normal action that induces a change in the beverage dispensing system is the activation of a beverage dispensing control means, e.g. a tapping handle, which results in a pressure change in the corresponding pressure chamber such that the beverage flows from the corresponding beverage container which consequently is collapsed further. The beverage will flow through the beverage dispense line and through the tapping line into a glass/cup. All this may be the subject of detection such that the beverage dispensing system can be surveyed.

But many of these actions and changes happens in short time periods and it would therefore be an advantage that the surveillance can be provided in real-time or at least substantially in real-time. This can be provided if the at least one measuring device is configured to have a high sampling rate, preferably a sampling rate of at least 5 Hz, more preferably at least 10 Hz, even more preferably at least 25 Hz, yet more preferably at least 50 Hz and most preferably at least 100 Hz. With a high sampling rate even small changes in the beverage dispensing system can be detected such that the beverage dispensing system can be monitored in real-time. Hence, timestamps can be provided and stored regarding an action and/or an event, such as beverage tapping, such as when a given amount of a given type of beverage was dispensed.

By employing electronic and network connectable sensors/measuring devices the data generated by the high sampling rate needs to be managed. Data can either be processed and/or stored locally, but it is also an option to process and/or store data centrally, e.g. in a cloud based service, if the system and/or the measuring devices is network/internet connectable. This further provides the option of a third party getting access to the generated data, i.e. such that the supplier(s) of beverage to the beverage dispensing system also can monitor and survey the beverage dispensing system.

The beverage outlet of the collapsible beverage container may be connected to the base part by an intermediate tapping line, which can be a part of the tapping line between the beverage outlet and the base part.

The intermediate tapping line can preferably be part of the replaceable collapsible beverage container, so that when the collapsible beverage container is empty and needs to be replaced with a new, full collapsible beverage container, the intermediate tapping line is replaced as well. The part of the tapping line, which is not replaced when the collapsible beverage container can be called the stationary tapping line.

When the collapsible beverage container is emptied, gas, like e.g. $CO_2$, from the head space of the collapsible beverage container may enter the tapping line. When beverage from another new collapsible beverage container is subsequently dispensed foam will exit the tapping head. Such foam cannot be served and has to be disposed of so that quite a lot of beer may have to be wasted.

However, if gas only enters the intermediate tapping line but not the rest of the tapping line, the intermediate tapping line can be exchanged together with the collapsible beverage container, when the collapsible beverage container is empty, so that no gas is left in the part of the tapping line that is stationary.

With the measuring device configured for monitoring at least one physical quantity of the intermediate tapping line like e.g. the pressure inside the intermediate tapping line and/or the optical absorbance across the intermediate tapping line and/or the electrical impedance across the intermediate tapping line and/or the acoustical characteristics across the intermediate tapping line, the beverage dispensing system can warn the user by activating an alarm device like a sounding alarm device or a flashing alarm device that gas has entered the intermediate tapping line so that the user can stop dispensing beverage before the gas enters the stationary tapping line and/or the beverage dispensing system can comprise a processor that can control the tapping device or a valve along the tapping line to automatically stop dispensing of beverage when the processor receives data from the measuring device that gas has entered the intermediate tapping line. If the processor receives data from the measuring device that gas has entered the intermediate tapping line, the processor will control the tapping device or the valve along the tapping line to close the tapping device or the valve along the tapping line before gas enters the stationary tapping line.

There will be no foam, since no gas will enter the stationary part of the tapping line, and extremely little beer will be wasted, since there will only be a tiny quantity left in the intermediate tapping line.

The invention further relates to a beverage dispensing system for dispensing a beverage, said beverage dispensing system comprising:

one or more kegs for accommodating a beverage, wherein the keg(s) comprise(s) a beverage outlet, a pressure source configured for driving the beverage out of the keg(s) through the beverage outlet, a tapping device comprising one or more tapping heads for extracting the beverage from the keg(s), a tapping line extending from said beverage outlet to said tapping device, said tapping line comprising one or more beverage lines, and at least one measuring device configured for monitoring at least one physical quantity of the tapping line, said measuring device configured to have a sampling rate of at least 10 Hz, wherein the beverage dispensing system is configured for processing data from the measuring device(s), and detecting an event in the system by continuously analysing data from the measuring device(s).

The keg(s) is/are a standard keg preferably made metal like stainless steel or aluminium, where the keg is pressurized by a pressure source of e.g. $CO_2$ or $N_2$. This disclosure can have all the advantages mentioned regarding the beverage dispensing system of claim 1. This disclosure can be combined with any feature of the dependent claims and can have all the advantages mentioned in reference to the claims.

The invention further relates to a method for monitoring a beverage dispensing system as described herein.

DETAILED DESCRIPTION OF THE INVENTION

Figure 1:
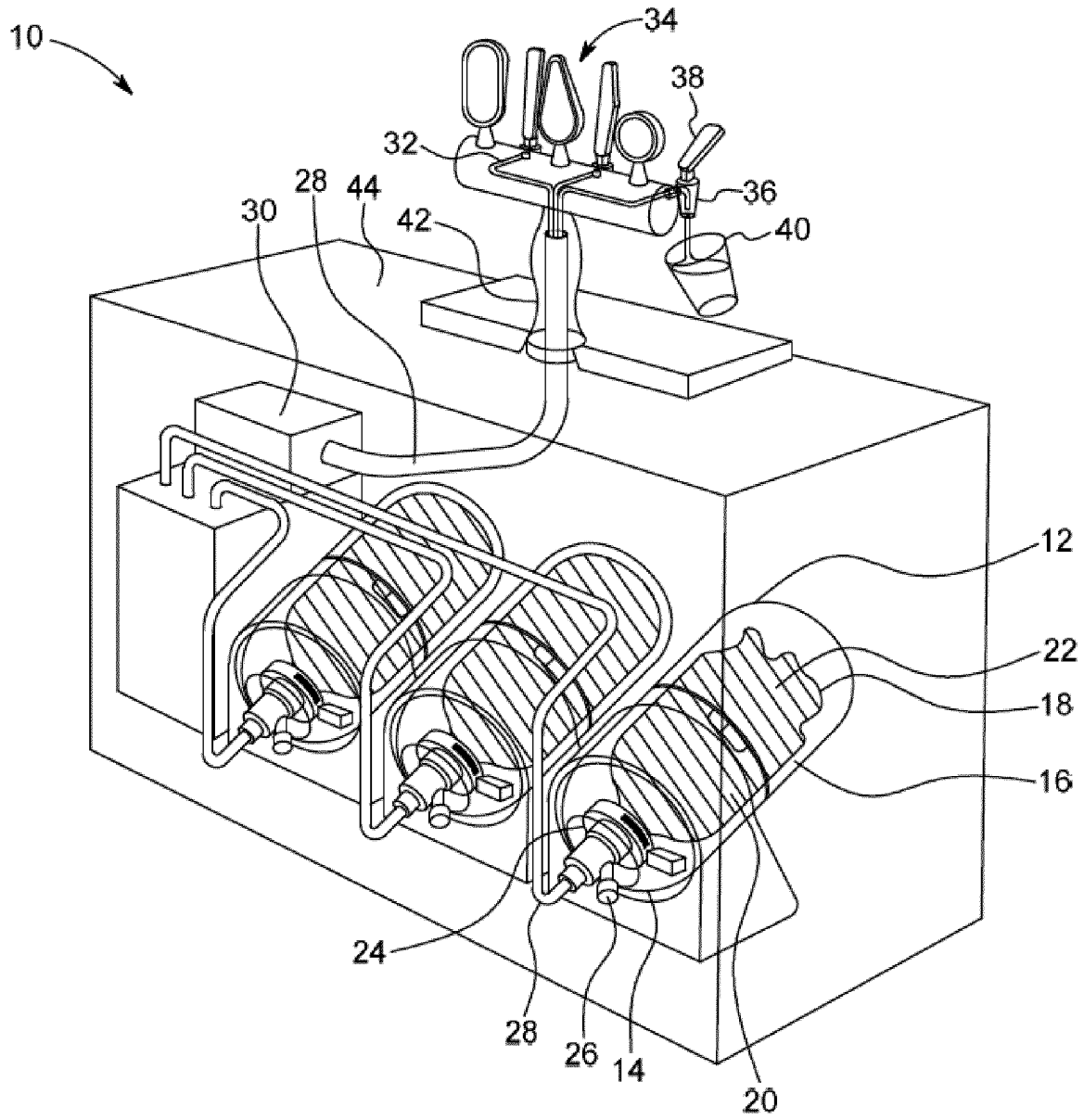
FIG. 1 is a beverage dispensing system as a modular system comprising collapsible beverage filled containers.

A measuring device as used herein may comprise an analogue sensor, a digital sensor or combinations thereof. An analogue sensor, such as a sensor retrieving information of the pressure within the sealed inner space, may then convert the information retrieved into digital information, such as a digital signal. The measuring device may also be a digital sensor. A combination of these is also possible.

The presently disclosed beverage dispensing system may be configured for processing data from the measuring device(s). This may be provided by means of a processing unit for processing the data which can be part of the beverage dispensing system. However, alternatively or supplementary, the beverage dispensing system may be configured for uploading data from the measuring device(s) via a network connection to a central server and/or a cloud service, and the system may be further configured such that the data is processed by said server and/or cloud service.

With the possibility of continuous surveillance and processing of the data generated by the measuring device(s), the presently disclosed beverage dispensing system may consequently be configured for detecting an action in the system, i.e. by continuously analysing data from the measuring device(s). An action as used herein will typically be a change in the system, i.e. an event that takes place over a short period of time that induces a change in one or more physical properties of the system that can be detected with one or more sensors, i.e. pressure, temperature, movement/acceleration, sound, liquid flow, etc. A period of time which preferably is less than 10 seconds, more preferably less than 5 seconds, most preferably less than 1 second, i.e. sub-second, or even less.

In the preferred embodiment an action is selected from the group of: operation of a tapping head, operation of a specific tapping head, change of a tapping head state, change of a specific tapping head state, flow of beverage in the tapping line, flow of beverage in a specific beverage line, opening or closing of a specific pressure chamber, operation of pressurisation unit, collapsing of a specific collapsible beverage container, and final collapse of a specific collapsible beverage container.

"Operation of a tapping head" means operation of an unspecified tapping head in the beverage dispensing system possibly comprising a plurality of tapping heads, i.e. the action can be activation or deactivation of a tapping head but information of which tapping head is active is not necessarily known.

"Operation of a specific tapping head" means operation of an identified tapping head in the beverage dispensing system possibly comprising a plurality of tapping heads, i.e. the action involves activation or deactivation of a specific and well-defined tapping head in the tapping area, i.e. activation or deactivation of the beverage dispending control means associated with the tapping head. Knowing the specific tapping head there will typically be a one-to-one correspondence with the corresponding pressure chamber, collapsible beverage container and/or beverage type associated with the specific tapping head.

The operation of a tapping head, as described above, generally changes the state of the tapping head from open to dosed or vice versa. This state is also referred to herein as the tapping head state.

"The state of a tapping head" or the "tapping head state" corresponds to the state of the valve of the tapping head, which can be either "open" or "closed", wherein "open" means that beverage is allowed to flow through the tapping head and "closed" means that no beverage is allowed to flow through the tapping head.

"The state of a specific tapping head" means the state (open/closed) of an identified tapping head in the beverage dispensing system possibly comprising a plurality of tapping heads, i.e. the state refers to a specific and well-defined tapping head in the tapping area.

"Flow of beverage in the tapping line" means that there is flow of some beverage somewhere in the tapping line that can originate from various beverage containers, whereas "flow of beverage in a specific beverage line" means that flow of beverage is detected in well-defined beverage line that typically is associated with a specific pressure chamber, collapsible beverage container and/or beverage type.

"Opening or closing of a specific pressure chamber" typically means removal or attachment, respectively, of the lid of a pressure chamber, i.e. un-sealing or sealing of the pressure chamber such that the pressure changes rapidly with respect to atmospheric conditions, either increasing or decreasing pressure rapidly.

"Operation of pressurisation" unit means that the pressurisation unit, e.g. a compressor or a pump, is active/running which can be detected by noise, pressure, acceleration, etc., or simply a read-out directly from the unit indicating active or passive. More specific, but related, actions could be activation or deactivation of the pressurisation unit, i.e. the action of actually activating or deactivating the pressurisation unit which typically involves a short sub-second change in the condition of the pressurisation unit.

"Collapsing of a specific collapsible beverage container" means the actual collapsing of a beverage container that will take place during tapping, or right thereafter, from the beverage container, i.e. it is closely related to the actions of "operation of a specific tapping head" and "flow of beverage in a specific beverage line", but detection of the action of "Collapsing of specific collapsible beverage container" can for example be provided by an audio sensor, e.g. a microphone, that can detect the sound of collapsing, an acceleration sensor and/or optical sensor can detect the movement/change in shape during collapse.

"Final collapse of a specific collapsible beverage container" means the final emptying of liquid of the collapsible beverage container that will take place during tapping of the substantially last liquid from the beverage container, i.e. it is closely related to the actions of "operation of a specific tapping head" and "flow of beverage in a specific beverage line", but detection of the action of "Final collapse of a specific collapsible beverage container" can for example be provided by an audio sensor, e.g. a microphone, that can detect the sound of collapsing and the final collapse, an acceleration sensor and/or optical sensor can detect the movement/change in shape during the final collapse.

The presently disclosed beverage dispensing system may therefore be configured for detecting operation of a specific tapping head by correlation with a sub-second change in the condition and/or state of the base part, the lid and/or the sealed inner space adjacent the corresponding beverage container. One example is detecting operation of a specific tapping head by correlation with a pressure change in the sealed inner space adjacent the corresponding beverage container, e.g. detected by a pressure sensor located in the pressure chamber and configured for measuring the pressure in the sealed inner chamber.

And once operation of a specific tapping head can be detected, the presently disclosed system can be configured for determining the pouring volume of a beverage tapping in the system by correlating with the detected operation of a specific tapping head. For example by 1) detecting activation and deactivation of a specific tapping head by correlation with pressure changes in the sealed inner space adjacent the corresponding beverage container, and 2) determining the elapsed time between the activation and the deactivation of said tapping head. The pouring volume of a tapping head operation can then be determined by correlating the elapsed time between the activation and deactivation of said tapping head with a predefined and/or constant beverage flow rate in the system. Consequently, the remaining volume of a collapsible beverage container can be provided by determining the pouring volume of each beverage tapping of said beverage container and correlating with the known initial beverage volume of the beverage container.

Detection of an action may be provided by calculating the first, second and/or third derivative of data, such as raw data, from the measuring device such that changes in said at least one monitored property can be detected. This is also exemplified in FIG. 4.

In the preferred embodiment the tapping line comprises a plurality of beverage lines, each beverage line corresponding to a specific beverage type and adapted to cooperate with a tapping head of the tapping device, each tapping head corresponding to said beverage type. Each pressure chamber may comprise a beverage container connector for connecting one of said tapping heads to the beverage outlet of the corresponding collapsible beverage container.

In one embodiment the collapsible beverage containers are part of the system and wherein each of said collapsible beverage containers defines a beverage filled space, a gas-filled head space and a beverage outlet in communication with said beverage filled space for extracting said beverage from said beverage filled space.

The sensor may be a pressure sensor for monitoring a pressure value, and/or a change in pressure, in the sealed inner space or in the tapping line. In a bar environment, there is generally a number of tap handles, or other functionality to activate beverage dispensing, each tap handle typically associated with a beverage container. By activating the tap handle, beverage starts flowing from the beverage container, through the tap lines, and out of the tapping head. Thus, there is a direct connection between the action of the tap handle and the flow of beverage out through the tap. It is thus of interest to automatically detect the operation of a tapping head and the inventors have realized that this can be provided by monitoring the pressure in the sealed inner space surrounding the collapsible beverage containers and/or by monitoring the pressure in the tapping line or in a beverage line, in particular by monitoring the pressure in real-time as explained above. A change in pressure in the sealed inner space or in the tapping line, in particular an abrupt change in pressure, can be the result of several actions and/or events. It can be the activation and de-activation of the associated tap handle in contact with the corresponding beverage container, it can also be a compressor or vacuum source that kicks in and changes the pressure inside the sealed inner space. And it might also be when the pressure chamber is opened to change the beverage container. However, analysis of time resolved pressure data acquired with high sampling rate can quickly resolve which action caused the change in pressure, as will be explained below. Hence, it is possible to detect the activation of a tap handle in real-time by employing a measuring device with a high sampling rate.

And once it is possible to detect activation and deactivation of beverage dispensing per tap handle, it is possible to measure the pouring/flowing time of beverage, i.e. the duration of each single dispense operation from each beverage container. The inventors have further realized that once the pouring time is known, the pouring volume can be determined rather precisely, because it has turned out that the flow rate in a beverage dispensing system with collapsible beverage containers is substantially constant, at least this is the case for the DraughtMaster® system. The constant flow rate is typically in the range of 40 to 70 mL per second, more preferably in the range of 50 to 60 mL per second, even more preferably in the range of 50 to 55 mL per second, typically around 53 mL per second. Hence, a pressure sensor is suitable for detecting an action/change in the beverage dispensing system, e.g. the start and end time of the dispensing operation, and from these two measurements the time interval of the dispensing operation can be determined. Thus, with the presently disclosed approach it is possible to relate an event in a bar environment (e.g. the turn of a tap handle) to a pressure change in a beverage dispensing apparatus located possibly 5-30 meters away from the bar environment and estimate the pouring volume of each dispense operation from each tap handle.

Furthermore, the presently disclosed approach with high sampling rate is capable of relating the event to a specific beverage container even in the case of multiple beverage containers as part of one system, such as the DraughtMaster Modular 20 which can house up to eight collapsible beverage containers concurrently. In such a setup there is only one pressurisation unit (e.g. a compressor) to generate an elevated pressure in all the pressure chambers, each pressure chamber housing a collapsible beverage container; i.e. all pressure chambers share the same elevated pressure. Thus, it is seemingly a challenge to identify the exact beverage container that is being dispensed from, since the pressure change occurs in all the pressure chambers nearly at the same time. But experiments have shown that the high data sampling rate (10-100 Hz), allows for the detection of a quick change in the monitored property, such that a detected change can be associated with the relevant beverage container, in particular if there is a sensor located close to each beverage container.

One way of processing data, such as pressure data from the sealed inner space, is by differentiating the data representing the monitored property. Differentiation can be provided at least one time, preferably two times, in order to more clearly recognize a change in the property such that the start and end of each dispense operation can be detected from the data. The time interval of the dispensing operation can then be calculated as the temporal distance between the two "incidents" corresponding to the start and the end of the pour, respectively. The approach disclosed herein ensures that the quantity of interest, i.e. the time interval of the dispensing operation, is measured in an indirect and automatic way, preferably without any sensors ever contacting the beer. The present approach also ensures that no additional equipment related to the measurements need to be installed in the bar environment, e.g. in the tap handle.

Data are preferably uploaded to a cloud service and processed using cloud computing, since the installation of additional equipment is then kept at a minimum. By uploading the data related to the above-mentioned dispensing events to a cloud service, third parties, e.g. the beverage supplier, can also gain a more detailed insight in the sales events for each specific bar, and thus be able to customise e.g. the supply and selection of beverages for that bar. Additionally, the cloud solution offers means to process the data, such that the amount of extra equipment needed to be installed is kept at a minimum. Finally, the processed data can be visualised in an application for use on e.g. a tablet or a similar device, which ensures an improved overview for the bar manager/owner.

Assuming a constant volumetric flow rate of the beverage flowing out of the beverage dispensing system, the volume of the dispensed beverage can be estimated by multiplying the volumetric flow rate with the measured time interval, determined using the approach described above. Furthermore, the remaining volume of each beverage container may be calculated by subtracting said dispensed volume from the starting volume of the collapsible beverage container for each dispense operation detected for each beverage container.

There might be situations where the assumption of a constant beverage flow rate is not sufficiently accurate. In general, the flow rate may depend on a number of parameters such as the number of beverage containers, the model of the compressor, the age of the compressor, the length of the tapping line, the width of the tapping line, the model of the tap, and the type of tap regulator). Therefore, the presently disclosed approach may calculate the beverage flow rate using the continuously acquired data, i.e. data that is also acquired during beverage dispensing. Pressure data from the sealed inner space acquired with high sampling rate can provide an indication of the change in gas volume during beverage dispensing, e.g. the first derivative of the pressure data acquired during beverage dispensing provides an indication of the rate of volume change within the pressure chamber, which is directly related to the beverage flow rate. An estimate of the pouring volume can therefore be provided by integrating the rate of volume change during beverage dispensing.

The volume of the collapsible beverage container gradually decreases concurrently with beverage dispensing. This can affect the beverage flow rate during dispensing and consequently there is often a correlation between the remaining volume of the beverage container and the beverage flow rate—and this may again correlate with the pressure in the pressure chamber. Hence, if this dependence is known in general, i.e. 1) beverage flow rate vs. remaining volume, and/or 2) change in beverage flow rate vs. remaining volume of beverage container, the approximation of the real-time calculated beverage flow rate may be improved.

Another and/or a further improvement can be provided if the calculated beverage flow rate is compared to the actual measured flow rate at least for a period of time, e.g. the flow rate measured by means of direct flow rate measurements. At least this can be a means for normalizing the flow rate measurements. It can also utilized in a machine learning approach where a calculated base flow rate of the beverage container as a function of remaining volume and actual pressure in the pressure chamber, can be compared to the measured flow rate and adjusted for each beverage dispensing operation for each pressure chamber. For example by an equation like $FR_{new}=(1-i)*FR_{stored}+i*FR_{actual}$ where $FR_{actual}$ is the actually measured flow rate, $FR_{stored}$ is the flow rate for the specific pressure chamber, optionally at the specific remaining volume of the beverage container, and $FR_{new}$ is the adjusted specific flow rate that can be stored instead of $FR_{stored}$. i is an adjustment parameter that is selected to the situation such that the adjusted flow rate converges towards the measured flow rate such that the flow rate can be calculated by means of pressure measurements alone.

Suitably, a measuring device may be provided for measuring the resonance frequency after a perturbation of the pressure chamber or the collapsible beverage container, thus enabling useful information about the status of the pressure chamber and the keg itself, thereby increasing safety of the beverage dispensing system. Some of the actions described herein can be seen as perturbations of the beverage dispense system and the high sampling rate is provided to detect these perturbations. Suitably also, a measuring device for measuring the flow of gas in the pressure shell can be provided.

A cooling device may be adapted in the presently disclosed beverage dispense system, e.g. downstream said beverage connector and upstream said tapping device for cooling said tapping line. The cooling device may comprise a measuring device in the form of a temperature sensor for measuring the temperature of a cooing line running adjacent said tapping line and which is mounted on said cooling device. Hence, a temperature sensor is affixed the cooling device for obtaining the cooling tube flow temperature so that the temperature is measured at the cooling device. This enables proper serving temperature in instances where the cooling of the tapping line takes place by a separate cooling line running adjacent such tapping line (so-called "wet Python"). The serving temperature of the beverage, when this is a beer, is suitably 3-6° C. This serving temperature ($T_{serv}$) may be calculated as the average of the temperature of the cooling line at the point of leaving the cooling device (T1 in ° C.) and its temperature at the point of entering the cooling device when it is returned (T2 in ° C.), i.e. $T_{serv}$= (T1+T2)/2. Temperature T1 is suitably 3 or 4° C. and since T2 is normally above T1, if T1 is above 6° C., this can immediately be detected as an error message, thus indicating the status of the cooling device and tapping line, here in particular that the cooling device may not be working properly. The measuring device(s) in the form of temperature sensors for measuring the temperature of the tapping line may also be mounted on the cooling device. Suitably, a measuring device is adapted to a specific beverage line within the tapping line.

In another embodiment of a cooling device is adapted downstream said beverage connector and upstream said tapping device for cooling said tapping line, wherein said tapping line includes a measuring device in the form of a temperature sensor and the measuring device is mounted in the tapping line in close proximity to said tapping device. By close proximity is meant the measuring device being mounted within the last 30%, preferably the last 20%, more preferably the last 10% of the length of the tapping line, measured from the cooling device and until the tapping head of the tapping device, e.g. until the beverage dispensing control means, such as the tapping handle. This enables proper serving temperature in instances where the cooing of the beverage line takes place without the use of a cooling line running adjacent the beverage line (so-called "dry Python"). Where a font is provided, the sensor may be provided inside the font i.e. within the vertical portion of the font, or upstream the font just before the tapping line enters the font underneath the bar counter.

The present disclosure enables quickly identifying and correcting any misalignment of a monitored property or parameter in the beverage dispensing system, e.g. a property relating to the beverage, the pressure chamber, the cooling device, the tapping line, etc. For instance, if a related device or part of the beverage dispensing system in a bar has a failure, the technician being located far from the bar may become immediately aware of the issue and thus may arrive within a few minutes to fix the failure, hence reducing significantly any down-time period. As a particular example, if the beer temperature is decreasing, the technician may become aware of this immediately and quickly arrive at the bar, inspect and fix the cooling device of the beverage dispensing system so that the beer temperature has the desired level. Hence, the present disclosure enables not only use of information stored for use inside a drinking establishment, such as a bar, but also outside the drinking establishment due to the possibility of external surveillance.

Each of the beverage lines of the presently disclosed beverage system may include a measuring device in the form of a flow sensor, temperature sensor, or a combined flow and temperature sensor. A combined flow and temperature sensor is preferred. Suitably this sensor is in the form of black box, e.g. "clamp on" black box, operated by ultrasonic measuring system and including slot for beverage line insertion, e.g. beer tube insertion so that there is no contact with beverage. The combined flow and temperature sensor is preferably adapted to fit not only beverage lines such as beer tubes, but also cooling lines, i.e. cooing tubes.

This combined temperature and flow sensor enables continuous and accurate measurement of the pouring volume/beverage volume flow as beer is dispensed from a tapping head. Thereby, every time the beverage is dispensed, i.e. poured, the amount poured is measured, with an accuracy of about 10 ml per pouring. At the same time, the temperature of the beverage with an accuracy of about 0.5° C. is possible, thus rendering immediate information on the beverage about to be dispensed.

The pressure chamber, e.g. the base part, of the presently disclosed beverage dispense system may comprise a weighing device, preferably a digital weighing device, for continuously weighing the beverage container during dispensing and establish digital data representing a weight of the beverage container and a flow of beverage through the tapping device deduced via the weight. By continuously weighing the beverage container during dispensing, the loss in weight may be considered to correspond to the flow of beverage. In case the original volume of beverage is known, or alternatively in case the weight of the container without beverage is known, the amount of remaining beverage in the beverage container may be deduced using standard arithmetic.

A pressure sensor may further be provided and configured to measure the pressure of a fluid in the tapping line at the outlet of the collapsible beverage container thereby providing a measure of the pressure inside the beverage container. The pressure difference between the pressure inside the beverage container and the pressure within the sealed inner space can then be provided and monitored. Because of the height of the beverage within the collapsible beverage container, the pressure at the bottom will be higher while there is still beverage therein to be dispensed thereby providing an indication of the remaining volume of beverage in the beverage container.

Figure 11:
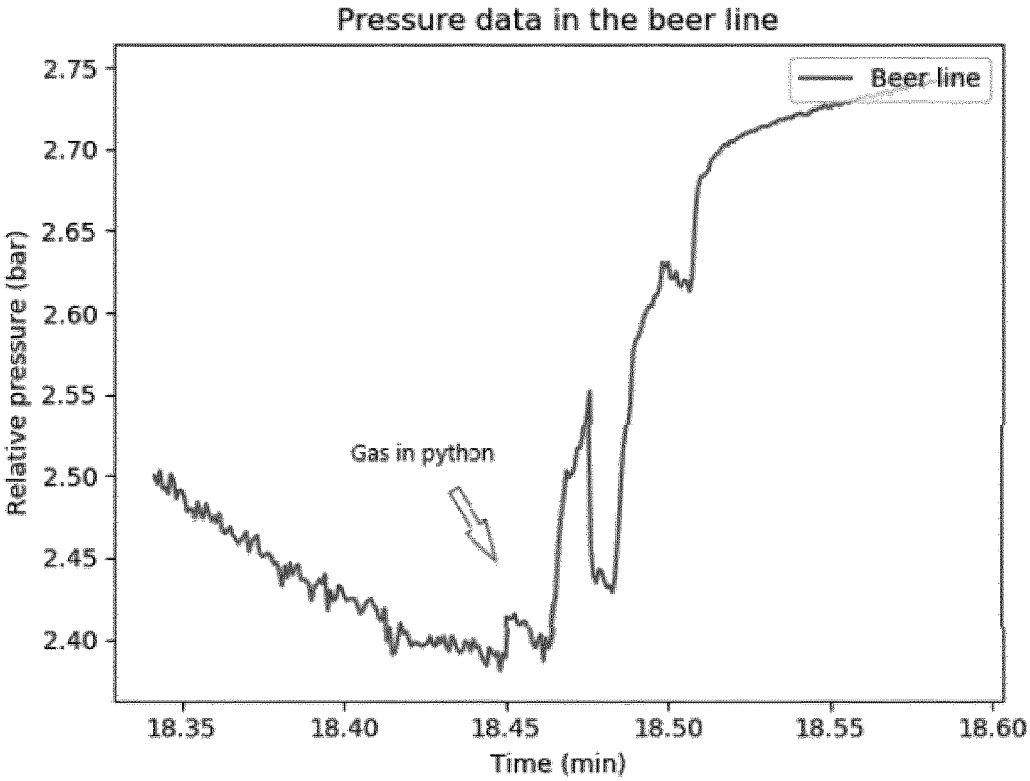
FIG. 11 shows yet another section of the pressure data displayed in FIG. 8. This section shows pressure data in the beer line from approximately 18.35 minutes to approximately 18.55 minutes of the experiment.

By monitoring the fluid pressure in the tapping line preferably near the outlet of the beverage container, the inventors have realized that a number of events related to the beverage dispensing system may be detected. These events may be detected by analyzing pressure data from a measuring device placed in the tapping line. The inventors have found that certain actions (e.g. the opening/closing of a tapping head) induce a sudden pressure change in the system; in fact both the fluid pressure in the tapping line changes abruptly upon such actions and the fluid pressure in the inner space of the pressure chamber changes abruptly as a consequence of the action. Other events such as the emptiness of a beverage container may further be detected, since there is a pressure change associated with the escape of gas into the tapping line (python). Such an event is illustrated in FIG. 11, which displays pressure data in the tapping line. At approximately the 18.45-minute mark, gas from the beverage container is introduced into the python, whereby the pressure in said python increases. Accordingly, pressure changes may be correlated with certain actions and events of the beverage dispensing system.

Alternatively, the measuring device may be placed outside the tapping line in order to establish a non-invasive measuring method, wherein the method is capable of determining a property of the fluid contained in said tapping line. As an example, the measuring device may comprise an optical sensor configured for determining the presence of gas and/or foam in the tapping line. The measuring device may also comprise an ultrasonic sensor configured for said purpose, i.e. for determining the presence of gas and/or foam in the tapping line. An excessive amount of foam and/or gas in the tapping line (i.e. beer line) typically indicates that the beverage container is empty or nearly empty. It is therefore of interest to detect the exact moment when this event occurs, such that the bartender or bar manager knows that the beverage container is empty and such that the dispensing from said container is immediately stopped and the amount of dispensed foam is minimized or completely avoided.

There are different advantages associated with the (at least) two different positions of the measuring device. By positioning the measuring device inside the pressure chamber, both pouring events (start/stop) as well as keg changes (due to de-pressurization of the pressure chamber) may be accurately detected. Another advantage of this position of the measuring device is that it is a non-contact method, i.e. the sensor does not touch the beverage. The method may also be used to estimate the remaining contents of the beverage container, since the starting volume is known and the number of pours including the dispensed volume of each pour is calculated from the method described herein. On the other hand, by positioning the measuring device inside the tapping line near the outlet of the beverage container, it is possible to detect when the beverage container is empty as opposed to a calculation/estimation. This is possible, because the method is able to detect gas or foam in the tapping line, which indicates that the beverage container is empty of beverage.

As stated previously the actions of "collapsing of a specific collapsible beverage container" and "final collapse of a specific collapsible beverage container" are related to the detection of the actual physical collapse process of the beverage container. One way of detecting these actions are by means of audio technology, e.g. by the provision of an audio sensor, e.g. a microphone, in proximity to the specific pressure chamber. A microphone can for example be provided along with a pressure sensor that measures the pressure inside the sealed inner space of the pressure sensor.

Figure 7A:
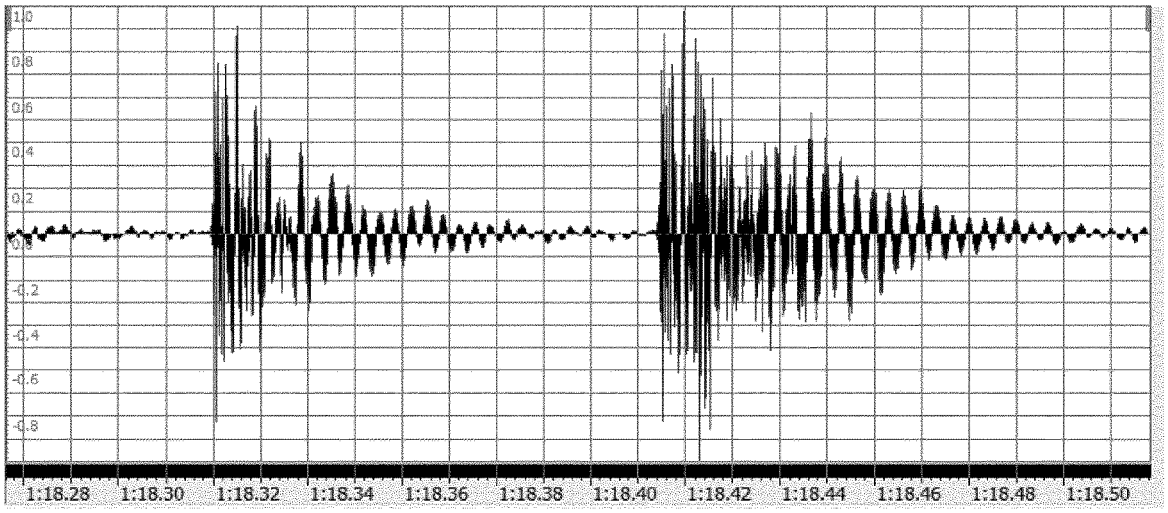
FIGS. 7A-C show an audio recording of the sound of the final collapse of a collapsible beverage container.

The collapse of a collapsible beverage container does generate special sounds when the plastic crumbles and the sounds become more and more pronounced when the volume of liquid inside the beverage container is reduced. I.e. gradually increasing sounds, e.g. in terms of frequency and/or amplitude of the sounds, from the beverage container is a sign of the beverage container becoming empty. In the pressure chamber there will at least be sounds from the compressor (or other pressurization unit) and from the collapse of beverage container, but these two sounds are distinguishable because the compressor provides a continuous sound whereas the sound of the beverage container collapsing is a pulsing sound, as exemplified in FIG. 7A where two of these characteristic short pulses are shown (amplitude vs. time). As seen from FIG. 7A the pulse has duration of approx. 0.05 seconds with the most characteristic high amplitude pattern within the first 0.02 seconds.

Figure 7B:
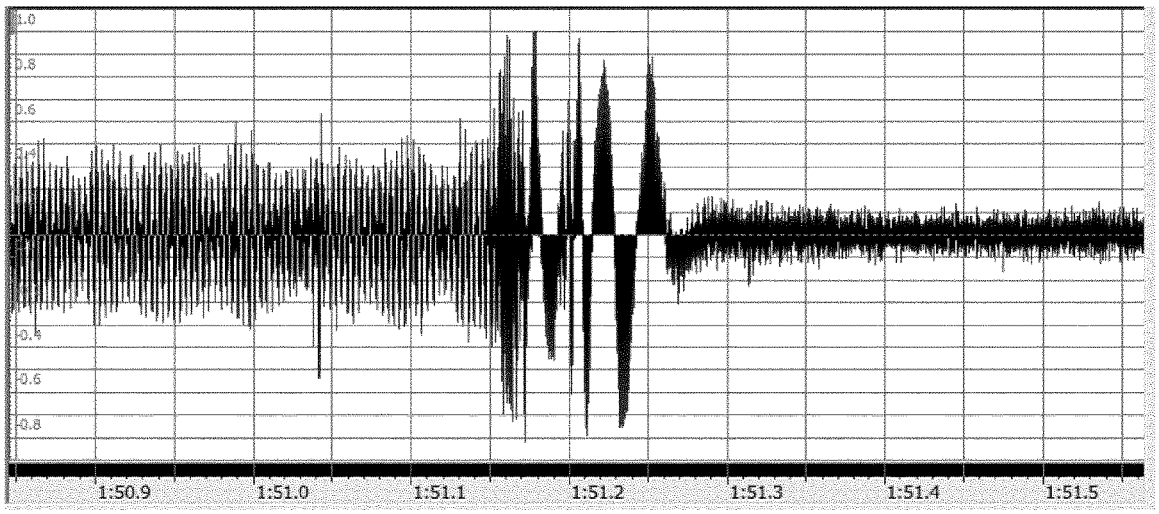
Figure 7C:
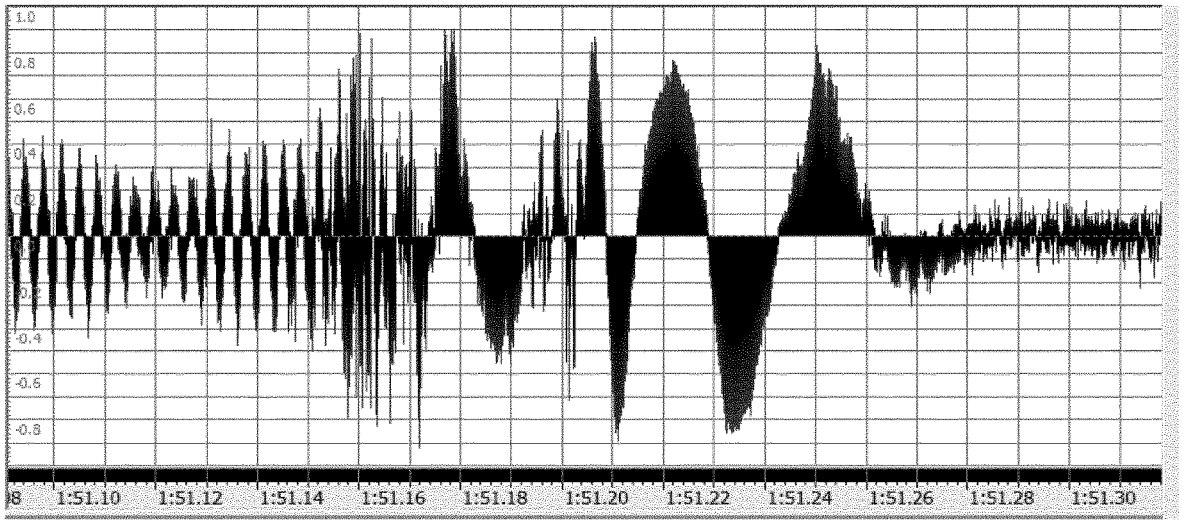

The present inventors have further realized that when collapsible beverage containers of the types used herein become empty, a special sound is generated, i.e. the action of "the final collapse of a specific collapsible beverage container" can be detected which provides a clear indication that the beverage container is empty. The sound of the final collapse is exemplified in FIGS. 7B and 7C showing an audio recording of the final collapse showing the amplitude vs. time of the recorded sound. It is the same recording in FIGS. 7B and 7C, with FIG. 7C being a close-up of FIG. 7B. The sound is like a popcorn popping with a duration of approx. 0.1 second and a characteristic pattern. In comparison with FIG. 7A, the sound of the final collapse is seen to be different from the sound of the non-empty beverage container collapsing.

This can be utilized to inform the bar manager that the beverage container must be replaced and that no more tapping is possible. The presently disclosed approach can therefore also include that the system is configured such that tapping is prevented automatically from the specific beverage container as soon as final collapse is detected such that for example foam generation can be prevented.

Digital technologies are preferred since data handling and data processing are easier. A dynamic consumption feedback via dynamic view of the contents of the collapsible beverage container (collapsible keg) is possible, so that the staff and the manager of the drinking establishment are continuously informed. For instance, a keg in a beverage dispensing system comprising a plurality of collapsible kegs may provide information to the staff or bartenders as well as a manager of a first keg having a certain type of beer A and how much the keg is filled with a beverage, e.g. a beer, say beer type A keg 60% filled. At the same time, information is also provided about the second keg, which may have another beer type B and is 80% filled, and about a third keg having a third beer type C with the keg being filled 10%. Such information suitably represented as:

Beer A, 60%
Beer B, 80%
Beer C, 10% may be displayed via a wireless connection such as Bluetooth or WiFi connection to a Tablet or smartphone or similar. Reordering of beer with suppliers may then be made automatically when defined low quantity of beer in keg is reached.

According to an embodiment, the data collected from the beverage dispensing system is uploaded and stored in a cloud solution or a cloud service. The data may also be stored and/or processed locally, e.g. by means of a general purpose computing device having a memory, storage device and processing unit. The data received about e.g. the pressure of the inner space or the time elapsed between the start of a dispensing operation and the end of a dispensing operation, may be stored and processed using cloud computing in order to calculate other properties related to the beverage dispensing system, such as the flow of beverage, the remaining volume, and/or the dispensed volume as well as other information of the beverage and/or collapsible beverage container. The processed data may be used as contents of an application running on a phone, tablet, computer or the like. Further, the data may be used to establish statistics about beverage consumption.

The beverage dispensing system may further comprise a pressure source such as a compressor, e.g. an air compressor, in fluid communication with said inner space for pressurising the inner space with an elevated pressure for applying a force onto said collapsible beverage container, collapsing said collapsible beverage container and forcing said beverage from said beverage filled space through the tapping line and out through the tapping device. Preferred pressurisation systems include reciprocating piston pumps.

The beverage dispensing system may also include a plurality of base parts and a plurality of lids connectable to the base parts thereby forming a pressure chamber. Thus, the present beverage dispensing system may be expanded to an assembly including a plurality of base parts and a plurality of lids. The respective beverage container connectors of the base parts may be interconnected by a common tapping line to form a series connected assembly of collapsible beverage containers; that is, as a modular system as also described in WO 2009/024147.

Another option is collapse the beverage container by means of a negative pressure as exemplified in pending application PCT/EP2018/083423 from the applicant company.

In this case the lid is flexible and a vacuum pump is provided to be in fluid communication with the inner space for depressurizing the inner space for causing the flexible lid to apply a force onto the collapsible beverage container, thereby collapsing said collapsible beverage container and forcing the beverage from said beverage filled space.

A flexible lid can be made of an elastic material such as rubber or alternatively a non-elastic flexible material such as plastic. Flexible in the context of the present patent application is understood to mean that it is made of a material, which will be deformed when a force is applied to the material, the material will yield and conform to the applied force without breaking.

Most non-rigid materials may be used as a flexible lid. The lid must be fluid-tight, but not able to resist pressure to any significant degree and must thus deform in accordance with the applied pressure. Both elastic materials, such as rubber, and non-elastic flexible material, such as plastic, are feasible. The flexible lid may thus conform to the shape of the beverage container during dispensing.

In one embodiment, the beverage from said beverage filled space of said collapsible beverage container is a beer pre-carbonized, possibly pre-mixed with nitrogen, with the collapsible beverage container preferably being made of a polymeric material such as plastic.

The methods disclosed herein may be used together with one or more of the embodiments of the presently disclosed beverage dispensing system.

The collapsible beverage container may be a single use collapsible beverage container. The terms "single use collapsible beverage container" or "single use collapsible keg" are used interchangeably throughout this disclosure. Suitably, it can be blow-molded and preferably having a volume between 5-50 liters, which is constituted by a beverage, filled space defined by the beverage and a gas filled head space which typically is carbon dioxide. The head space, being the inner volume of the pressure chamber subtracted by the volume of the beverage container, should be rather small when a new full beverage container is introduced in the pressure chamber, such as 5%—50%, preferably 10%-20%, of the initial volume of beverage. The collapsible beverage container contains a beverage outlet, which is closed off during transport and handling. The collapsible keg, instead of utilizing a plastic material such as PET, may use a multilayer foil.

When installed in a beverage dispensing system like the applicant's DraughtMaster®, the beverage container is typically oriented in a predetermined position such as an "upside down" position, i.e. the beverage outlet is oriented in a downward direction so that the head space is thereby oriented in an upwards direction. The base part is typically rigid and suitable for supporting the weight of the beverage container, and the beverage container connector forms a fluid-tight connection between the beverage outlet and the tapping line.

The lid is preferably connectable to the base part in a fluid-tight fashion in order to be able to form a hermetically sealed inner space, which has a suitable volume for encapsulating the beverage container.

The base part can be made of a rigid material in order to support the collapsible beverage container. In the context of the present patent application, a rigid material should be understood as being capable of supporting the weight of the beverage without bulging. Pressure is applied to the collapsible beverage container in order to apply a dispensing pressure for forcing the beverage from the beverage filled volume via the tapping line to the tapping head when the tapping valve is open as a result of the tapping handle being moved from its original vertical (close) position. The pressure should be sufficiently great to overcome the crumpling pressure of the collapsible beverage container plus the gas pressure of brewage, i.e. the pressure required for collapsing the beverage container, and as well overcome the pressure losses in the dispensing line, e.g. for elevating the beverage from a cellar located below a bar. Finally, a certain pressure at the tapping head is required for allowing a suitable flow velocity, however, too much flow or too small pressure may cause undesired foaming. As also disclosed above the energy for beverage dispensing can also be provided by a negative pressure, e.g. from a vacuum pump.

The tapping head typically comprises at least one tapping valve, which is controlled by a beverage dispensing control means, such as a pushing button or preferably a tapping handle for operating the tapping head. A user wishing to dispense beverage will, i.e. operation of a tapping head as used herein, for example move the handle from a vertical position to a horizontal position and thereby operate and open the valve for allowing a flow or stream of beverage from the beverage-filled space via the tapping line to the tapping head.

The tapping line typically comprises a plurality of beverage lines, preferably two to five beverage lines, more preferably three beverage lines, each beverage line corresponding to a specific beverage type and adapted to cooperate with a tapping head of the tapping device, each tapping head corresponding to said beverage type.

The term "a measuring device" may mean one or more measuring devices.

Examples

FIG. 1 shows a perspective view of a beverage dispensing system 10 having a pressure chamber comprising lid 12 and a rigid base part 14 which are sealed together establishing an inner space or inner volume 16 including a filled single use collapsible beverage container 18. The beverage container 18, also known as keg, is of the collapsible type made of a collapsible polymeric material, thus the term collapsible beverage container. The collapsible beverage container 18 defines a beverage filled space containing the beverage 20, typically being a carbonated beverage such as beer. The beverage container 18 also defines a gas filled head space 22 at its top portion, above the level of the beverage inside the beverage container 18, as better illustrated in FIG. 3.

The lid 12 and the rigid base part 14 are separable, but during operation they are sealed together for defining the inner space 16 for accommodating the beverage container 18. The lid 12 may e.g. be made of rubber. The collapsible beverage container 18 includes a closure 24 adapted to cooperate with a beverage container connector 26 for connecting the beverage outlet (not shown) of the collapsible beverage container 18 with tapping line 28. The tapping line passes through a cooling device or unit 30 in order to provide the beverage with the appropriate serving temperature, e.g. 3-6° C. for beer. Downstream the cooling device 30, the tapping 28 containing one or more beverage lines 32 reaches tapping device 34. The tapping device 34 comprises one or more tapping heads 36, with each tapping head 36 including a tapping handle 38 to dispense beer into beverage recipient (glass) 40.

Figure 2:
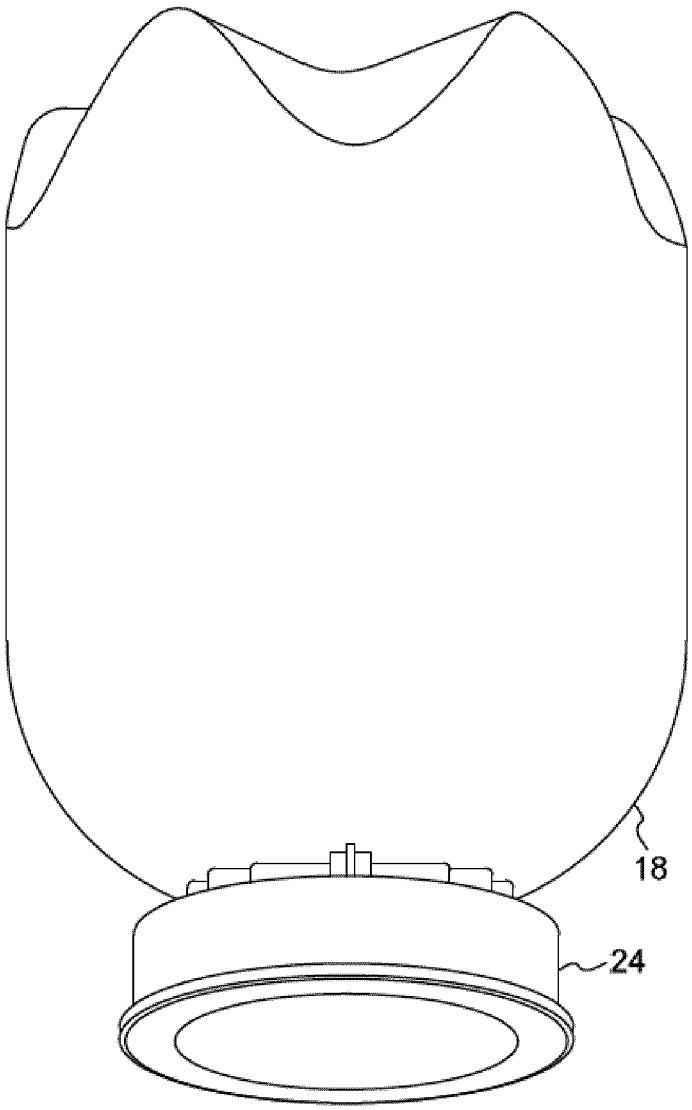
FIG. 2 is an illustration of a collapsible beverage container of FIG. 1.

Temperature sensor units (not shown) on the tapping line mounted close to the tapping device, just before reaching the bottom of font 42 or inside the font 42, may be provided to obtain a near serving temperature of the beer when poured in glass 40. FIG. 2 shows an expanded front view of the bottom portion of collapsible beverage container 18 including closure 24.

Figure 3:
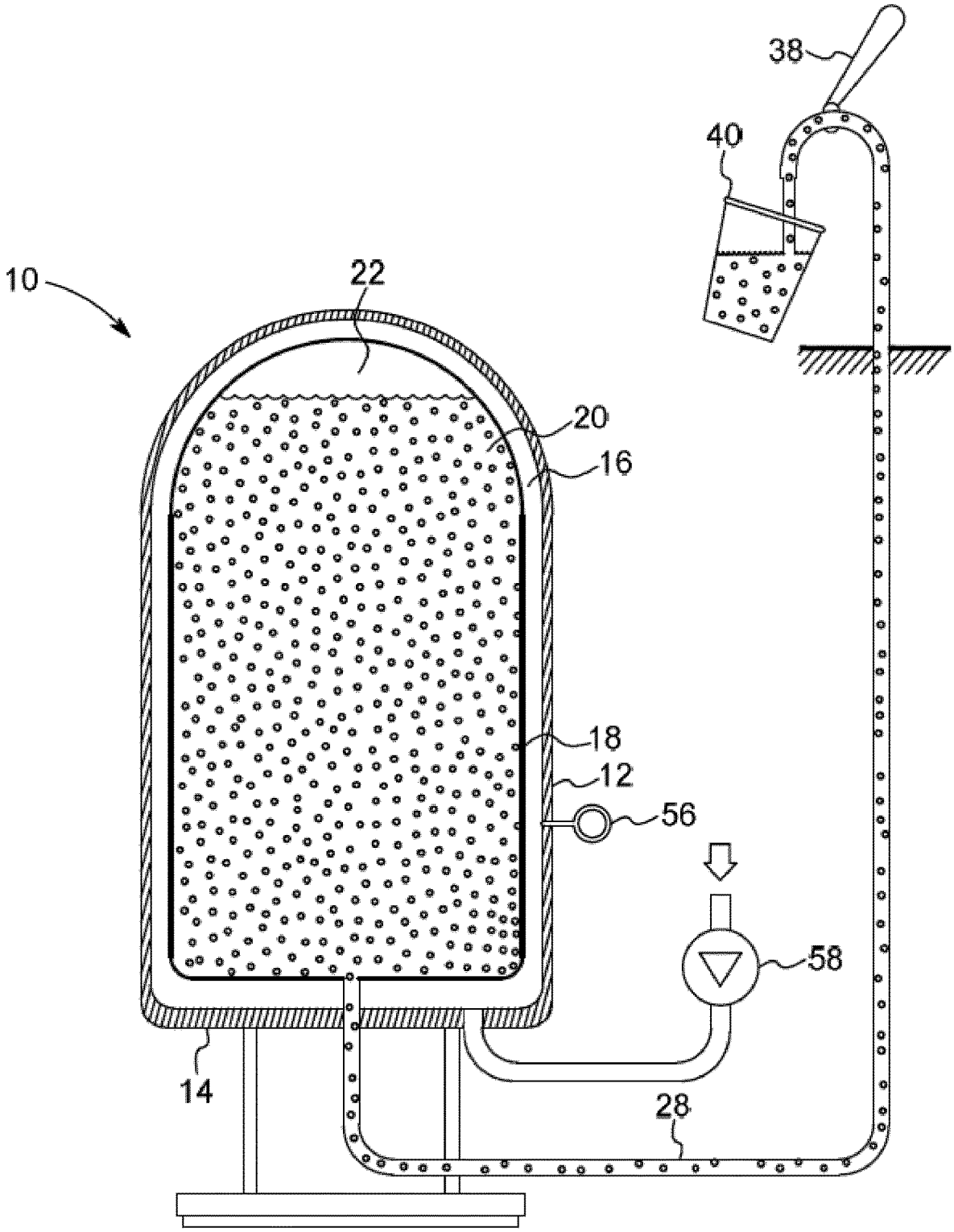
FIG. 3 is a beverage dispensing system having a flexible pressure chamber including a beverage filled keg and at least one pressure sensor.

FIG. 3 shows a schematic representation of beverage dispensing system 10' comprising a single collapsible beverage container contained in the inner space 16 created by the sealing of lid 12 and base part 14, tapping line 28 and tapping device 34, as described in connection with FIG. 1.

The base part 14 is also connected to a pressure source, such as an air compressor 58. The compressor 58 enables pressurizing the sealed inner volume 16 between the beverage container 18 and the pressure chamber comprising lid 12 and base part 14. When the tapping device 28 is enabling beverage flow, the pressure applied onto the beverage container 18 will result in its gradual collapse, as beverage is forced out of the beverage container 18 and towards the tapping device 28.

Figure 4:
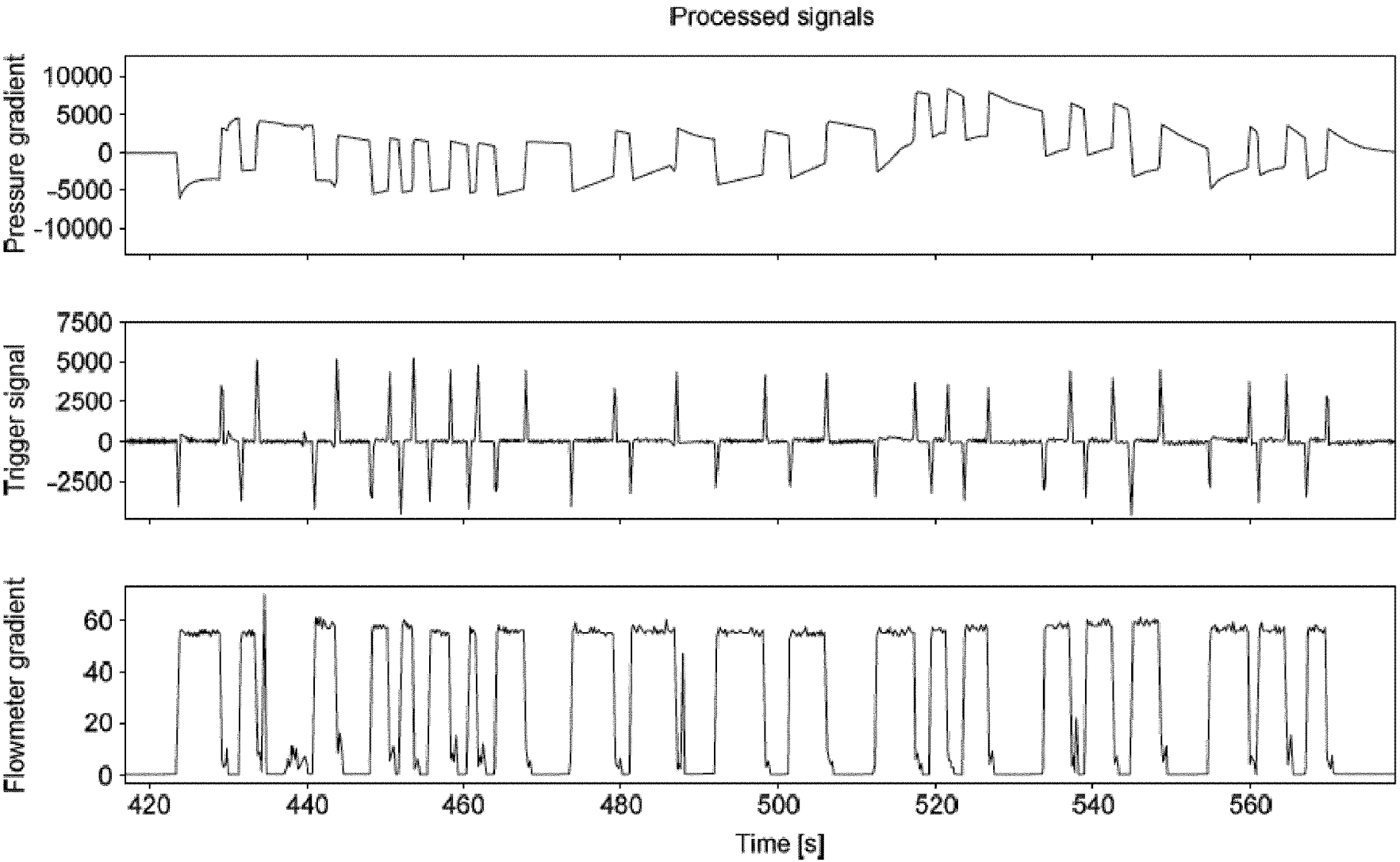
FIG. 4 shows three graphs. The top graph is the pressure gradient, i.e. the first derivative of raw pressure data acquired from a pressure sensor sampled with a sampling rate of 100 Hz and installed in the base part of a pressure chamber and configured to measure the gas pressure of the sealed inner space of an embodiment of the presently disclosed beverage dispensing system. The middle graph is the second derivative of the raw pressure data and the bottom graph is the first derivate of output from a flow meter The X-axis in all three graphs shows the elapsed time in seconds over approx. 160 seconds, i.e. from approx. 420 seconds to approx. 580 seconds.

FIG. 4 shows three graphs. The top graph is the pressure gradient, i.e. the first derivative of raw pressure data acquired from a pressure sensor sampled with a sampling rate of 100 Hz and installed in the base part of a pressure chamber and configured to measure the gas pressure of the sealed inner space of an embodiment of the presently disclosed beverage dispensing system. The middle graph is the second derivative of the raw pressure data and the bottom graph is the first derivate of output from a flow meter The X-axis in all three graphs shows the elapsed time in seconds over approx. 160 seconds, i.e. from approx. 420 seconds to approx. 580 seconds. During this time period a number of tapping operations were performed, i.e. beverage was tapped a number of times from a collapsible beverage container located in the pressure chamber by pulling the tapping handle. The Y-axis in the top graph with the pressure gradient is arbitrary units. As seen from the top graph the pressure gradient varies with time, each time the tapping handle is activated or deactivated the pressure gradient varies abruptly.

In order to mere clearly detect the action of the tapping handle, the first derivative of the pressure gradient is shown in the middle graph (labeled "trigger signal"), i.e. the second derivate of the pressure inside the sealed inner space. The middle graph very clearly shows each action of the tapping handle: A large peak down is activation of the tapping handle because the pressure in the sealed inner space drops when tapping from the beverage container is initiated. A large peak up is deactivation of the tapping handle because the pressure in the sealed inner space increases as soon as tapping stops. This example shows that actions in the presently disclosed beverage dispensing system can be detected by means of a high sampling rate measuring device in the form of a pressure sensor, in particular the action of a tapping handle, which can be very far from the beverage containers, can be detected by solely by monitoring the pressure in the pressure chamber.

When activation and deactivation of a tapping handle can be detected, as seen from the middle graph in FIG. 4, the pouring volume of each tapping operation can be determined by determining the time elapsed between activation and deactivation of the tapping handle and multiplying by an assumed/predefined/predetermined constant beverage flow rate.

The bottom graph in FIG. 4 shows the first derivate of the output of a flow meter that was provided as a control for verifying the pressure sensor approach. A high flow meter gradient is an indication of flow of beverage in the system. As seen when comparing the flow meter gradient in the bottom graph with the peaks in the middle graph there is a good correlation between flow in the system and each detected activation and deactivation of the tap handle. Hence, the presently disclosed approach is applicable for detecting actions in a beverage dispensing system and thereby determine parameters such as pouring volume and volume remaining in the beverage container.

Figure 5A:
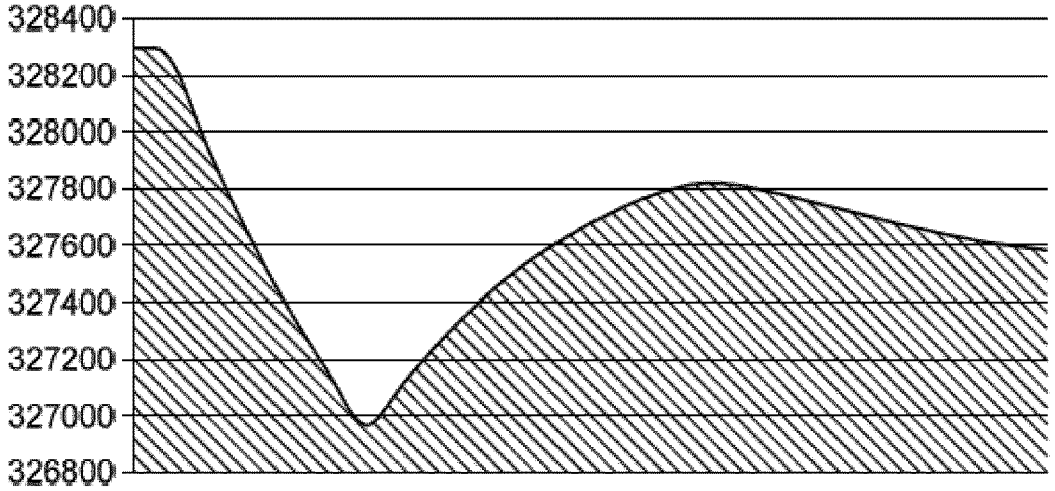
FIGS. 5A-C also show three graphs of a single beverage dispensing, i.e. a single pouring, with the raw pressure data shown in FIG. 5A, the first derivative thereof in FIG. 5B and the second derivate in FIG. 5C.
Figure 5B:
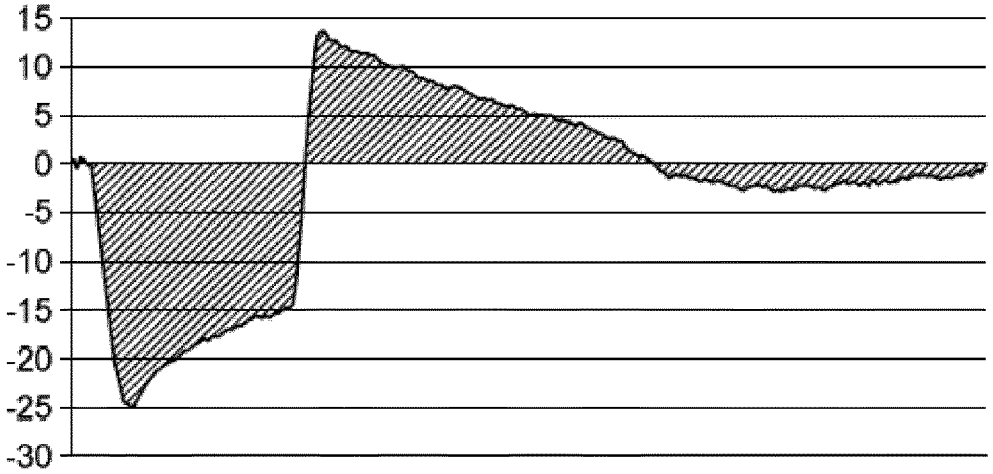
Figure 5C:
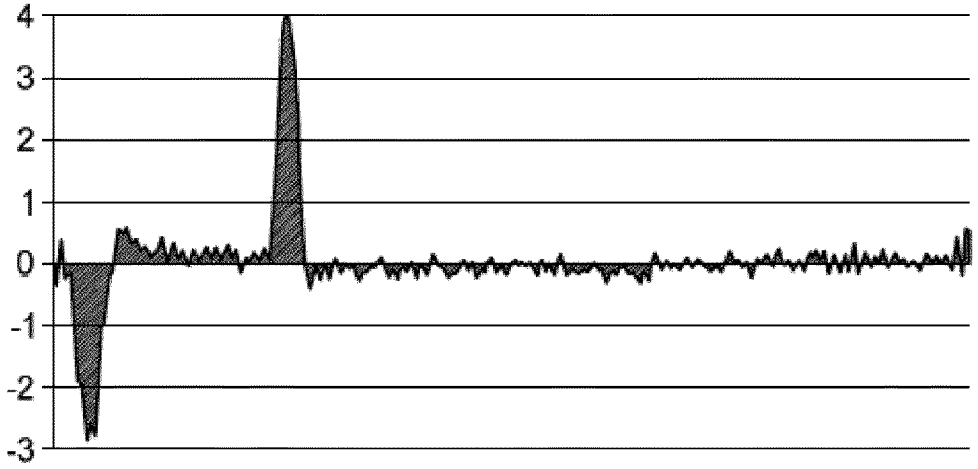

FIGS. 5A-C also show three graphs with the raw pressure data shown in the top in FIG. 5A, the first derivative thereof in the middle in FIG. 5B and the second derivate in the bottom in FIG. 5C. But FIG. 5 displays just a single pouring. The actual pouring of beverage takes place between the two peaks in FIG. 5C: The tapping handle is activated at the sharp "negative" peak and the tapping handle is deactivated at the sharp "positive peak". The start of the pour can be detected by checking the second derivative function for a value lower than a predefined trigger value $tr_1$. The end of the pour can similarly be detected by determining the point at which the second derivative function goes to positive values again. In FIG. 5A the pouring can be seen as the gradual pressure drop in the pressure chamber. When the pouring stops the compressor increases the pressure again as also seen in FIG. 5A. The first derivate of the raw pressure shown in FIG. 5B is a measure of the beverage flow rate as also mentioned above.

Figure 6:
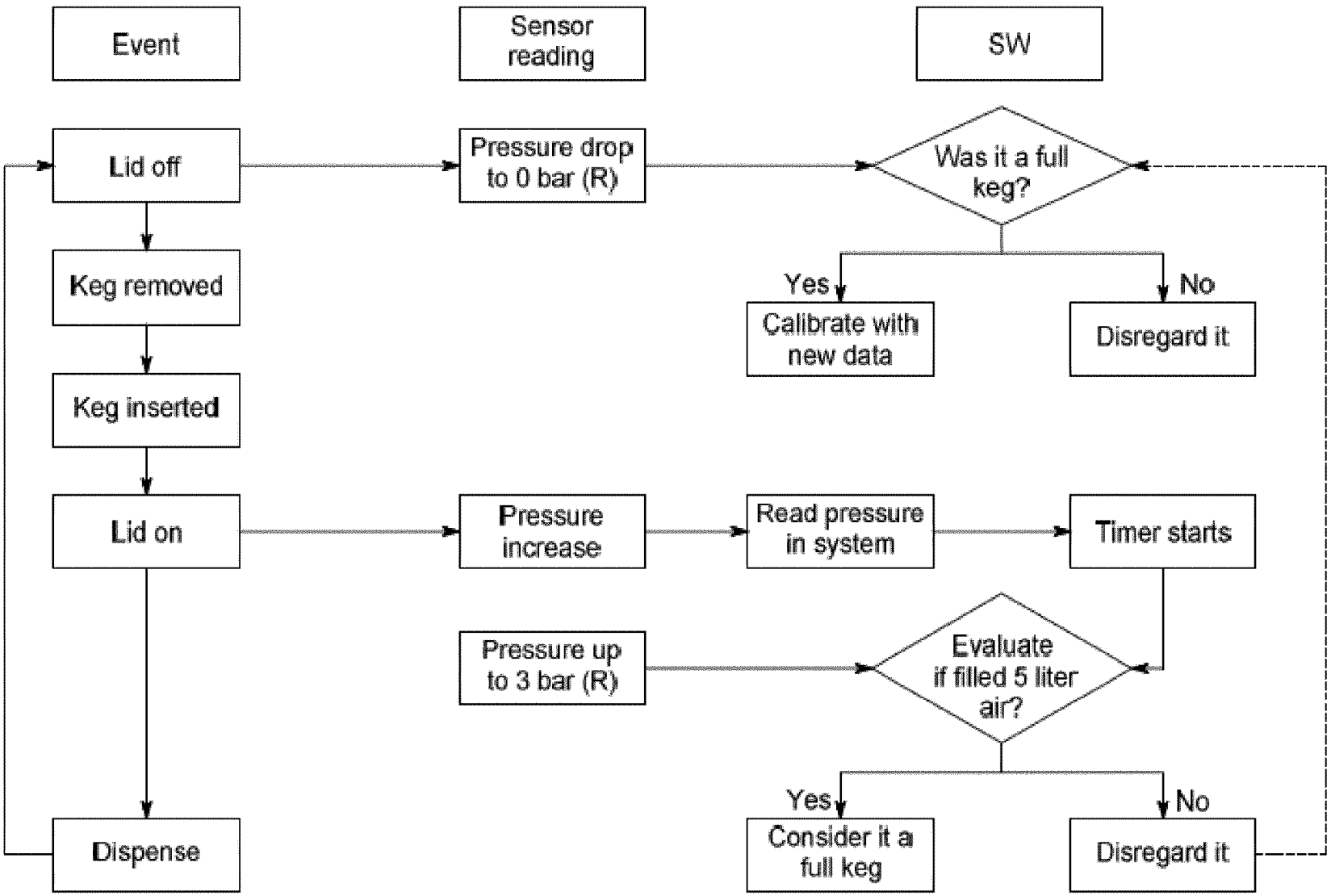
FIG. 6 shows a flow chart describing an example of how to detect "lid on" and "lid events/actions.

FIG. 6 shows a flow chart describing an example of how to detect and process "lid on" and "lid events/actions. When a keg is empty and must be replaced, the lid of the pressure chamber is removed, and the pressure inside the pressure chamber consequently drops abruptly, typically to atmospheric pressure, i.e. approx. 1 bar, which can be detected by a pressure sensor placed inside the inner volume of the pressure chamber. The old keg is removed, the new keg is inserted and the lid is re-attached, i.e. "lid on", such that beverage dispense can be resumed. The pressure increases again, which can be detected by the sensor. The time it takes to raise the pressure in the pressure chamber to approximately 3 bars can be calculated such that it can be evaluated whether it was a full keg that was inserted, e.g. if the pressure chamber is filled with the normal 5 liters of air. If it is not a full keg then maybe the lid of the pressure chamber was removed for other reasons. If it is evaluated that it was a full keg the system can for example be calibrated with new data.

An example of a pressure sensor that can be used in the presently disclosed measuring device is a digital pressure sensor (0-5 bar) from TE Connectivity, e.g. the MS5803-05BA which is a miniature altimeter and diving module and which can be hermetically sealed. Another option is to use piezo-electric sensors that can form compact and accurate pressure sensors.

An example of a temperature sensor that can be used in the presently disclosed measuring device is a programmable resolution 1-wire digital thermometer DS18B20 from Maxim Integrated.

An example of an acceleration sensor that can be used in the presently disclosed measuring device is a three-axis linear accelerometer, such as LIS3DH (from STMicroelectronics) which is an ultra-low-power high-performance three-axis linear accelerometer with digital I2C/SPI serial interface standard output.

An example of a processing unit that can be used in the presently disclosed measuring device, or in the system in general, is ESP32 (from Espressif Systems) which can perform as a standalone unit or as a slave device to a host MCU. The ESP32 can interface with other systems to provide Wi-Fi and Bluetooth functionality through its SPI/SDIO or I2C/UART interfaces and it can be integrated with in-built antenna switches, RF balun, power amplifier, low-noise receive amplifier, filters, and power management modules.

FIGS. 8-12 shows pressure data from an experiment conducted by the inventors. The experimental setup comprises a beverage dispensing system according to the present disclosure, a compressor for pressurising the pressure chamber of the beverage dispensing system, and at least one pressure sensor for measuring the pressure at least one place in the system. In this experiment, the pressure was measured two places in the system: In the air line connected between the compressor and the pressure chamber, and in the beer line (i.e. tapping line) of the beverage dispensing system. The tapping line extends from the outlet to a tapping device. The outlet should be understood as being either the outlet of the beverage container or the beverage outlet of the pressure chamber. There may be a small distance between these two outlets. This distance may be increased by connecting a beverage line between the outlet of the beverage container and the outlet of the pressure chamber. The measuring device may be placed near either of said outlets, i.e. the measuring device may be placed in between said outlets. The experiment lasted approximately 19 minutes. The purpose of the experiment was to demonstrate correlations between actions/events and pressure changes in the beverage system. The pressure sensor had a sampling rate of 20 Hz. The findings from the experiments will be outlined in relation to FIGS. 8-12 in the following. It is stressed that the FIGS. 8-12 show data from the same experiment. However, the figures display different ranges of the data in order to highlight important findings.

Figure 8:
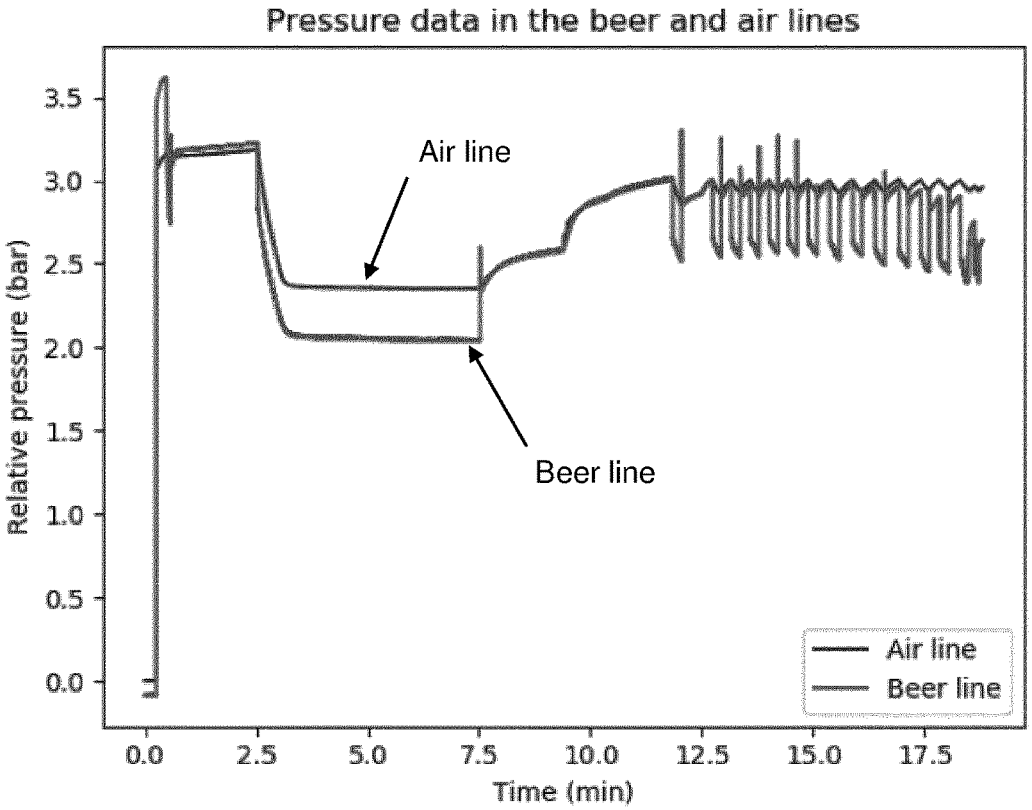
FIG. 8 shows pressure data from an experiment, wherein the pressure was measured in two separate fluid lines: an air line and a beer line (tapping line). The air line supplies the pressure chamber with compressed air from a compressor. The beer line delivers the beer from the beverage container to a tapping device, where the beer can be dispensed. The sampling rate of the measuring device (pressure sensor) was 20 Hz for this experiment.

FIG. 8 shows the entire data set from the experiment. During the first approximately 2.5 minutes, the pressure builds to approximately 3.2 bar (both in the air line and in the beer line). From the 2.5-minute mark to the 7.5-minute mark, the tap was open and beverage was continuously dispensed from the system in order to drain a large amount of beverage from the beverage container. During this time interval, the pressure in the air line is greater than the pressure in the beer line since the tap is open and beverage is flowing. At approximately the 7.5-minute mark, the tap was closed and the dispensing operation discontinued. From this point, the pressure builds in the system (inner space of the pressure chamber and in the beer line) due to the work performed by the compressor. It is seen that the pressure in the air line and the beer line is approximately equal. From approximately the 12-minute mark, a series of tapping operations (open/close events) were performed until the beverage container was depleted of beer (occurring at approximately the 18.45-minute mark), which is more clearly seen in FIG. 11. The aforementioned tapping operations generally change the state of the tapping head from open to closed or vice versa.

Figure 9:
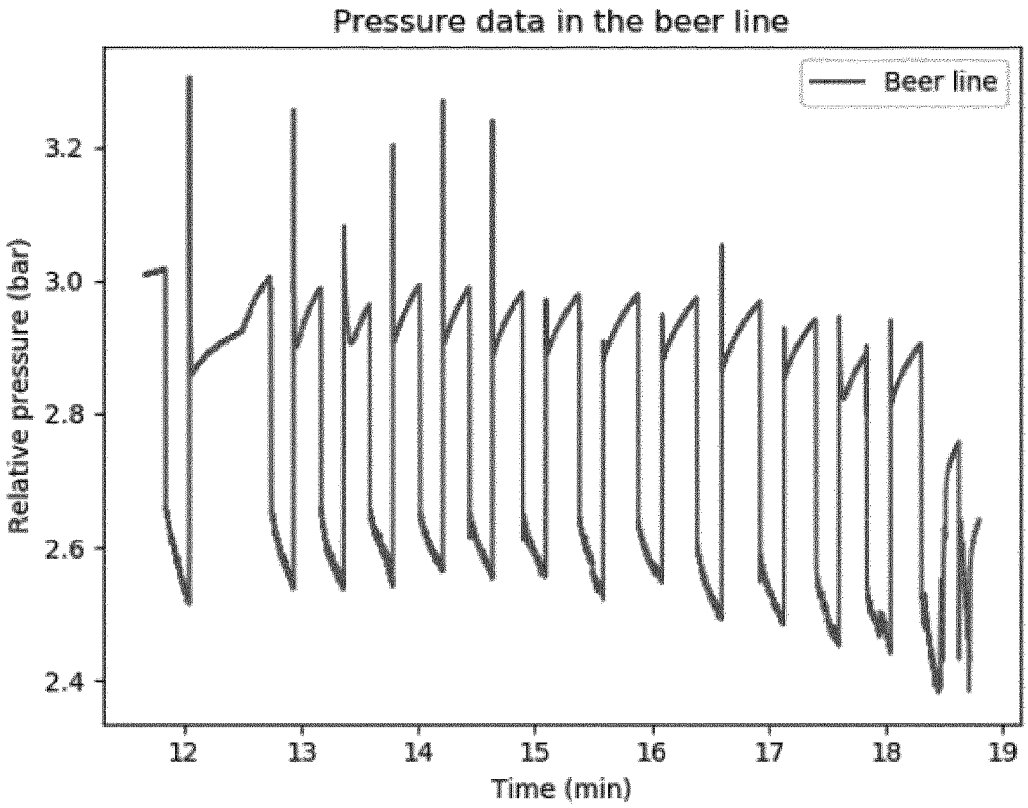
FIG. 9 shows a section of the pressure data displayed in FIG. 8. This figure displays the pressure data obtained in the beer line from approximately 12 minutes to approximately 19 minutes into the experiment, whereas FIG. 8 displays the full data set from both fluid lines extending from 0 minutes to approximately 19 minutes.
Figure 10:
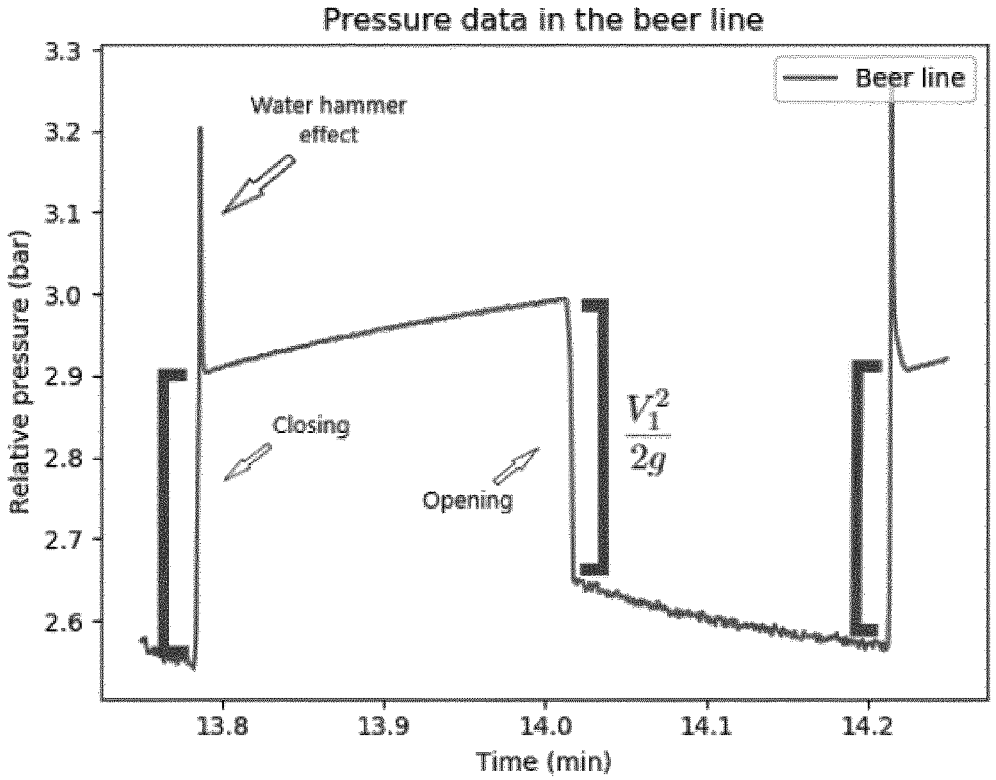
FIG. 10 shows a further zoom-in on the pressure data displayed in FIG. 9. This figure shows pressure data in the beer line from approximately 13.7 minutes to approximately 14.3 minutes of the experiment.

FIG. 9 shows a selected range of the pressure data in the beer line shown in FIG. 8. This figure shows data from approximately the 12-minute mark to approximately the 19-minute mark. The figure displays a dose-up of the series of tapping operations performed during the experiment. The thin peaks of high amplitude occur due to the water hammer effect when the tapping head is dosed. The abrupt pressure drop for each cycle occurs when the tapping head is opened. FIG. 10 shows a further close-up of the data shown in FIG. 9.

FIG. 10 shows a selected range of the pressure data in the beer line shown in FIG. 8. This figure shows data from approximately the 13.7-minute mark to approximately the 14.3-minute mark. The figure displays a close-up of a single dispensing cycle comprising the actions of (closing the tapping head), opening the tapping head, and closing the tapping head again. At approximately the 13.78-minute mark, the tapping head is closed inducing an abrupt change in pressure in the beer line. The sharp peak occurring at this point in time is a result of the water hammer effect, which occurs due to the quick closure of the valve when the tapping head is closed. While the tap is closed, the pressure builds from approximately 2.9 bar to approximately 3.0 bar due to the work performed by the compressor. At approximately the 14.0-minute mark the tapping head is opened again causing an immediate pressure drop. The pressure drop occurs because the system is open to the outside (lower) pressure, which causes the beverage to flow, meaning that some of the potential energy associated with the high pressure is converted to kinetic energy driving the fluid through the tapping line and out of the tapping head. The magnitude of the pressure drop corresponds to the squared velocity of the beverage divided by 2g, where g is the gravitational acceleration. While the tapping head is open, the pressure decreases because the compressor cannot maintain a constant pressure during beverage dispensing. However, the work of the compressor counteracts the drop in pressure, meaning that the speed of the pressure drop decreases during the dispensing operation (the curve flattens out). At approximately the 14.2-minute mark, the tapping head is closed: The pressure rises with a corresponding amount that it previously dropped and a pressure spike (due to water hammer) is observed again. Accordingly, the present system and method is able to detect actions such as the opening and closing of a tapping head by monitoring the pressure e.g. in the beer line. Provided the flow rate of the beverage is known, the dispensed volume of a single pour can be calculated by multiplying said flow rate with the time elapsed between the opening- and closing event of the tapping head.

FIG. 11 shows a selected range of the pressure data in the beer line shown in FIG. 8. This figure shows data from approximately the 18.35-minute mark to approximately the 18.60-minute mark. The figure displays a dose-up of an event where the beverage container is emptied of beverage. It is observed that at approximately the 18.45-minute mark, the pressure rises. However, contrary to the abrupt pressure change associated with the dosing of the tapping head, the pressure rise associated with the emptiness of the beverage container is much less steep and abrupt. The latter pressure change occurs because gas is present in the tapping line (i.e.

python), indicating that the beverage container is empty of beverage. Since the two pressure changes associated with the two different events are that different in character, the observed pressure change can be attributed to a specific event (e.g. the opening/dosing of a tapping head or the emptiness of a beverage container).

Figure 12:
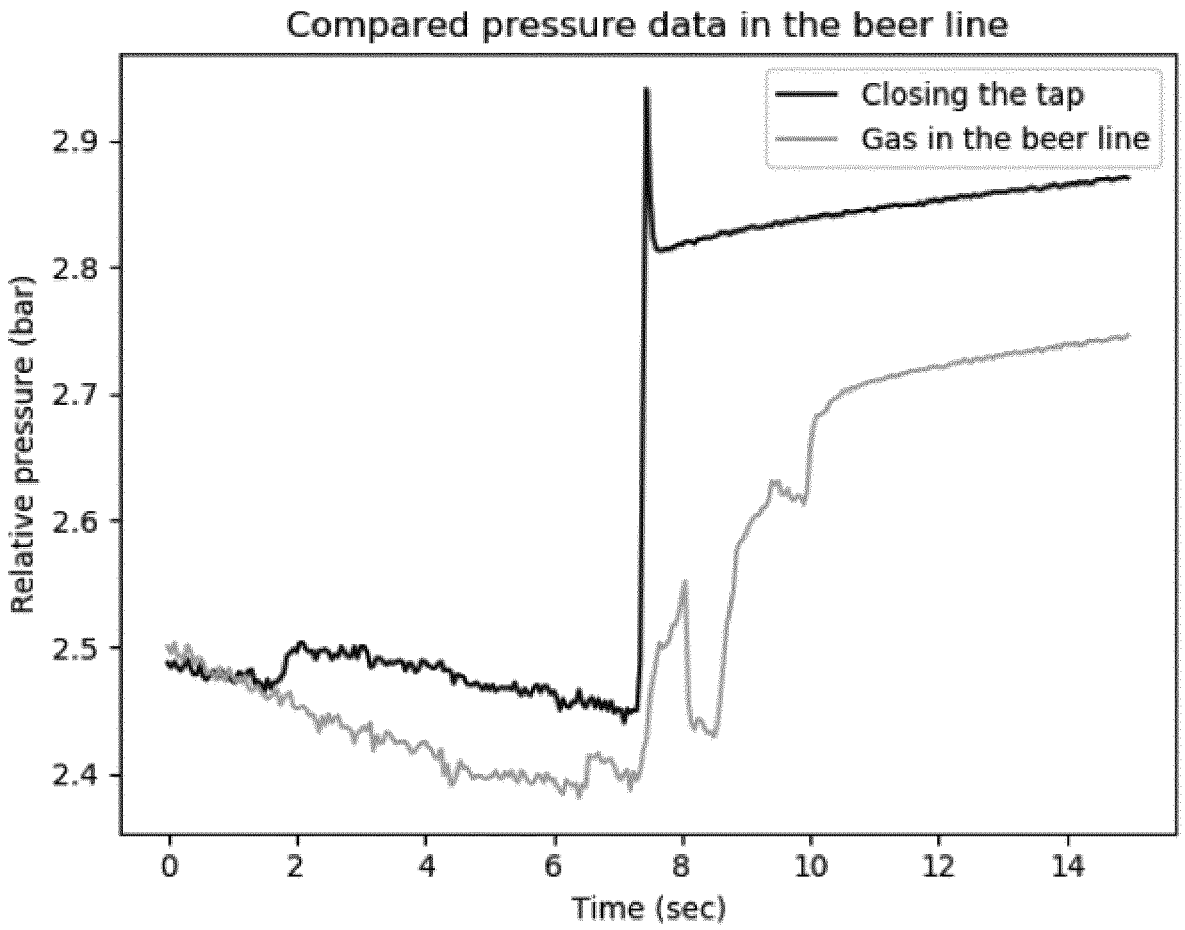
FIG. 12 shows an overlay of two different events of the beverage dispensing system. The two graphs were obtained in the same experiment (as described in relation to FIG. 8); here the two events are superposed at the same time stamp for illustrative purposes. The first event relates to the closing of the tapping head, whereas the second event relates to emptying the beverage container whereby gas is introduced in the beer line. Both events can be detected using the presently disclosed system and method.

FIG. 12 shows two graphs associated with two separate events of the beverage dispensing system; said two graphs are overlaid in the same figure for illustrative purposes only. The data shown were obtained in the experiment explained in relation to FIGS. 8-11. The dark-grey curve corresponds to an event wherein the tapping head was closed followed by an abrupt increase in pressure. The light-grey curve corresponds to an event wherein the beverage container was emptied and gas (from the headspace of the beverage container) was present in the beer line. It is observed that the pressure change associated with the two different types of events are vastly different. The pressure change associated with the closing of the tapping head occurs abruptly, i.e. the pressure increase by a large amount (here more than 0.3 bars) over a short period of time, typically less than a second. Hence, it is preferred to use a pressure sensor with a high sampling rate (at least 10 Hz) in order to detect such fast dynamics/changes and to detect the exact time that the event happened. The pressure change associated with the presence of gas in the beer line is on the other hand much slower (typically above 1 second), and also typically of a smaller magnitude than the pressure change associated with the opening and/or dosing of the tapping head.

Figure 13:
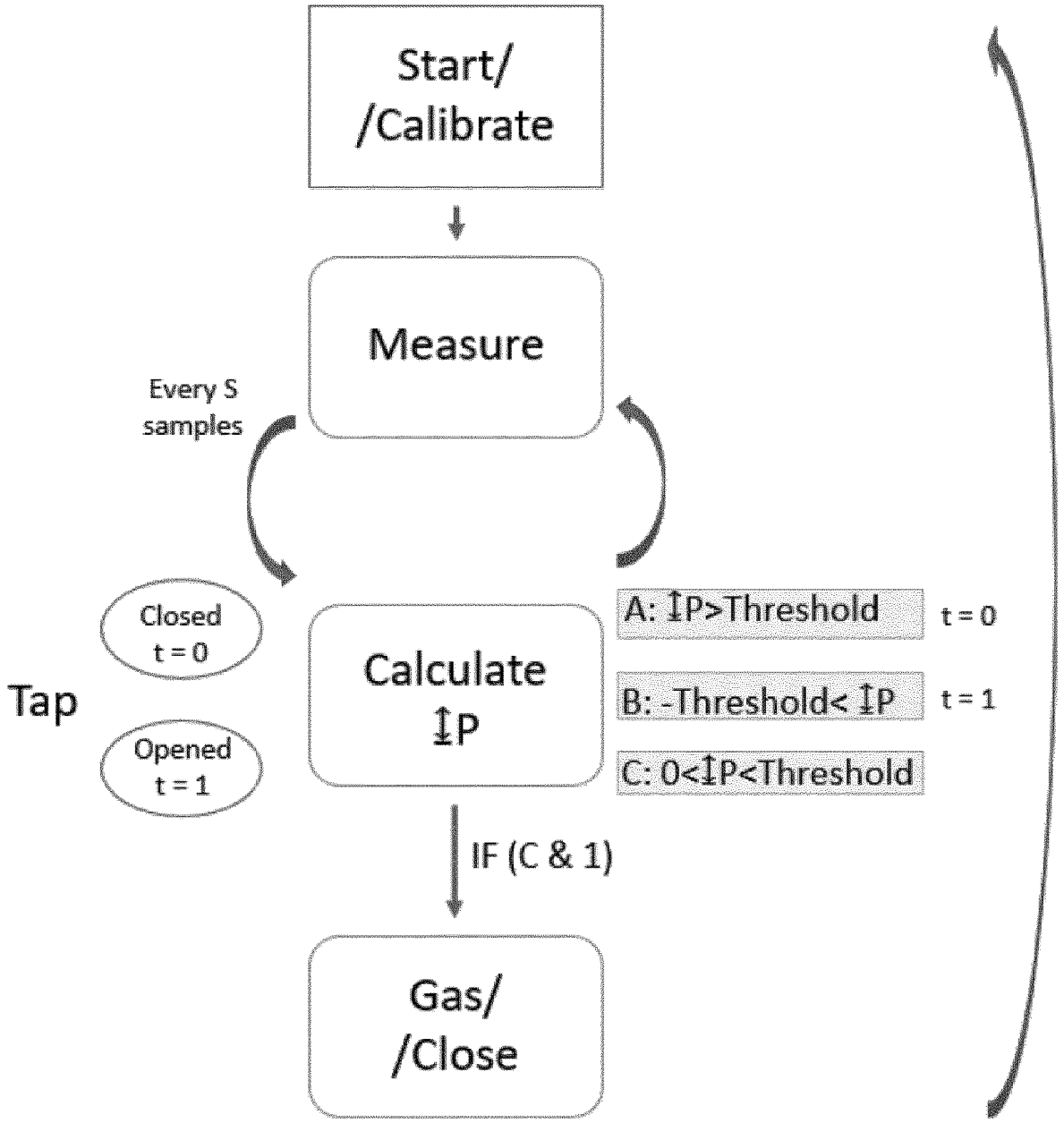
FIG. 13 shows a method of monitoring a beverage dispensing system according to the present disclosure. The method preferably comprises the step of measuring a property of the beverage dispensing system using a measuring device, e.g. a pressure sensor. The method may preferably employ a processing unit for continuously calculating e.g. the pressure difference in order to distinguish different events of the system. Such events may relate to opening/closing of a tapping handle and/or the emptiness of a beverage container. The system is able to distinguish said events based on different predefined conditions and/or thresholds. As an example, the pressure may be measured continuously in the beer line, preferably using a pressure sensor with a high sampling rate.

FIG. 13 shows an example of a method of monitoring a beverage dispensing system according to the present disclosure. The method may preferably begin with a calibration of the measuring devices or other components of the system. The next step is then to measure, preferably continuously measure, one or more physical quantities, e.g. pressure, temperature or other parameters. Said quantities may be measured at one or more positions in the beverage system. Examples of measuring positions include: The tapping line, the inner space of the pressure chamber, the air line, etc. The next step of the method is to calculate, preferably continuously calculate, the changes in the measured quantities. At this step, the system evaluates whether the change/difference in the measured quantity exceeds a predefined threshold value. The measurement- and calculations step may occur concurrently in a loop, and the two steps may be continuously repeated until certain predefined conditions are met. Said conditions may relate to the magnitude of the change in the measured quantity compared to a predefined threshold.

The following describes how the method may be implemented to monitor a beverage dispensing system in order to detect different types of actions/events occurring in the system. The system comprises a pressure sensor placed in the tapping line, said sensor being configured to measure the fluid pressure of a fluid contained in said tapping line. An example of a fluid contained herein may be a beverage such as a beer, but it may also be a gas, or combinations thereof, such as foam. The pressure sensor obtains pressure data at a given sampling rate (e.g. 20 Hz), and continuously compares new values of the pressure with recent values in order to obtain a pressure difference between the pressure obtained at two different points in time. If a positive pressure difference exceeds a given predefined threshold (corresponding to a pressure increase), it corresponds to an event wherein the tapping head was closed. Conversely, if said pressure difference is negative with a magnitude exceeding aforementioned threshold (corresponding to a pressure drop), this can be attributed to an event wherein the tapping head was opened. The time stamps of these events can then be used to calculate a time interval during which the tapping head was open. This time interval may then be multiplied by the flow rate in order to obtain the dispensed volume of beverage during the associated beverage dispensing event. If said pressure difference is positive (pressure increase) but below the specified threshold, this typically indicates that gas has entered the tapping line and that the beverage container is empty. In this example, the last step of the method occurs when two conditions are met: The tapping head is open (t=1) and the pressure difference is between zero and the given threshold. In this case, the beverage outlet is closed, since it indicates that the beverage container is empty. The method may be repeated for a second beverage container.

Figure 14:
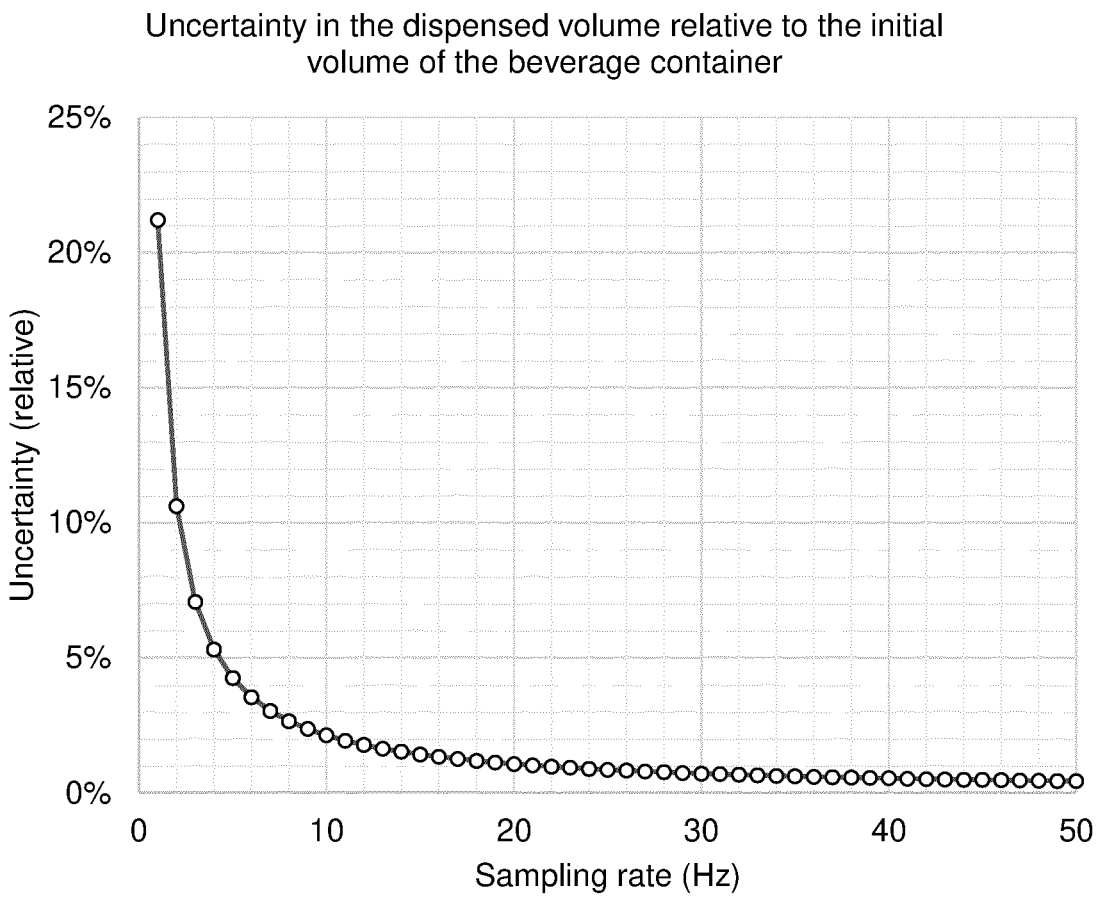
FIG. 14 shows a graph of an estimated uncertainty in the dispensed volume relative to the initial volume of the beverage container, said uncertainty plotted versus the sampling rate of the measuring device used.

FIG. 14 shows a graph of an estimated uncertainty in the dispensed volume relative to the initial volume of the beverage container, said uncertainty plotted versus the sampling rate of the measuring device utilized to detect the start- and endpoints of a series of dispensing operations, supposing a flow rate of 53 mL per second, supposing the collapsible beverage container to have a volume of 20 L, and supposing a service size of 0.5 L, which means 40 openings and 40 closings of the tapping device. From the graph it is observed that the relative uncertainty is inversely proportional to the sampling rate of the measuring device.

An advantage of using a measuring device with a high sampling rate is the ability to capture the dynamics of the measured quantity, i.e. how fast it changes in value. An example is the pressure in the sealed inner space, which changes abruptly on a short time-scale, typically of less than one second (sub-second), cf. FIG. 12. Hence, in order to capture these fast changes in the measured quantity and determine the time stamp of the change, it is desirable to use a measuring device with a high sampling rate, preferably a sampling rate of at least 10 Hz. Generally, the more accurately the start and end of the pouring operation are determined, the more accurate is the estimation of the dispensed volume and consequently the estimation of the remaining volume of the beverage container. In general, the uncertainty in the dispensed volume is inversely proportional to the sampling frequency and directly proportional to the dispensing rate. This relation is shown in FIG. 14, which displays a graph of the uncertain volume relative to the total initial volume of the beverage container. The uncertainty may be lowered by using a measuring device with a higher sampling rate. From the graph, it is seen that the uncertainty drops significantly for sampling rates between 1 Hz and 10 Hz. Therefore, a value of at least 10 Hz is a good choice when also taking the cost of the sensor in consideration. The uncertainty of the total dispensed volume (and thereby of the remaining volume) is approximately 2% of the initial volume when using a measuring device with a sampling rate of 10 Hz, with the assumptions mentioned above.

REFERENCE NUMERALS

10. Beverage dispensing system
12. Flexible lid
14. Base part
16. Inner space
18. Collapsible beverage container
20. Beverage
22. Head space
24. Closure
26. Connector
28. Tapping line
30. Cooling device

32. Beverage line
34. Tapping device
36. Tapping head
38. Tapping handle
40. Beverage recipient (glass)
42. Font
44. Bar counter
56. Pressure sensor
58. Compressor Further details of the present disclosure 1. A beverage dispensing system for dispensing a beverage, said beverage dispensing system comprising:
   one or more pressure chambers comprising a connectable base part and lid defining a sealed inner space for accommodating and encapsulating a collapsible beverage container having a beverage outlet connectable to the base part,
   a tapping device comprising one or more tapping heads for extracting the beverage from the collapsible beverage container(s),
   a tapping line extending from said base part(s) to said tapping device, said tapping line comprising one or more beverage lines, and
   at least one measuring device for each pressure chamber configured for monitoring at least one property of the corresponding sealed inner space, base part, lid and/or collapsible beverage container.
2. The beverage dispensing system according to item 1, wherein said measuring device is in the form of an analogue sensor, a digital sensor, or combinations thereof.
3. The beverage dispensing system according to any of the preceding items, wherein said measuring device comprises a pressure sensor configured for monitoring the pressure in the sealed inner space.
4. The beverage dispensing system according to any of the preceding items, wherein said measuring device comprises a pressure sensor configured for monitoring the pressure in the tapping line.
5. The beverage dispensing system according to any of the preceding items, wherein said measuring device comprises a temperature sensor configured for monitoring the temperature in the sealed inner space.
6. The beverage dispensing system according to any of the preceding items, wherein said measuring device comprises an acceleration sensor configured for monitoring acceleration/movement of the base part, the lid and/or the corresponding collapsible beverage container.
7. The beverage dispensing system according to any of the preceding items, wherein said measuring device comprises an audio sensor, such as a microphone, preferably configured for monitoring sound from the base part, the lid and/or the corresponding collapsible beverage container.
8. The beverage dispensing system according to any of the preceding items, wherein said measuring device is configured to have a sampling rate of at least 10 Hz, more preferably at least 50 Hz.
9. The beverage dispensing system according to any of the preceding items, wherein the system is configured for processing and/or analysing data from the measuring device(s).
10. The beverage dispensing system according to item 9, comprising a processing unit for processing the data.
11. The beverage dispensing system according to any of the preceding items, wherein the system is configured for processing data from the measuring device(s) via a network connection to a central server and/or a cloud service.
12. The beverage dispensing system according to any of the preceding items 9-11, configured for detecting an action in the system by continuously analysing data from the measuring device(s).
13. The beverage dispensing system according to item 12, wherein an action is selected from the group of: operation of a tapping head, operation of a specific tapping head, flow of beverage in the tapping line, flow of beverage in a specific beverage line, opening of a specific pressure chamber, operation of a pressurisation unit, collapsing of a specific collapsible beverage container, and final collapse of a specific collapsible beverage container.
14. The beverage dispensing system according to any of the preceding items, configured for detecting a change in a measured physical quantity associated with a change in the condition and/or state of the base part, the lid, the tapping line, and/or the sealed inner space adjacent the corresponding beverage container, wherein said detected change is the result of an event of the beverage dispensing system.
15. The beverage dispensing system according to item 14, wherein the type of event can be determined based on the detected change in the measured physical quantity.
16. The beverage dispensing system according to any of items 14-15, wherein the event is the operation of a tapping head or the operation of a specific tapping head.
17. The beverage dispensing system according to any of the preceding items 9-13, configured for detecting operation of a specific tapping head by correlation with a sub-second change in the condition and/or state of the base part, the lid and/or the sealed inner space adjacent the corresponding beverage container.
18. The beverage dispensing system according to any of the preceding items, configured for detecting a sub-second change in a measured physical quantity associated with the condition and/or state of the base part, the lid and/or the sealed inner space adjacent the corresponding beverage container, wherein said sub-second change is correlated with the operation of a specific tapping head.
19. The beverage dispensing system according to any of the preceding items 9-17, configured for detecting operation of a specific tapping head by correlation with a pressure change in the sealed inner space adjacent the corresponding beverage container.
20. The beverage dispensing system according to any of the preceding items 9-19, configured for detecting operation of a specific tapping head by correlation with the sound of collapse of the corresponding beverage container.
21. The beverage dispensing system according to any of the preceding items 9-20, configured for determining the pouring volume of a beverage tapping operation in the system by correlating with the detected operation of a specific tapping head.
22. The beverage dispensing system according to any of the preceding items 9-21, configured for 1) detecting activation and deactivation of a specific tapping head by correlation with pressure changes in the sealed inner space adjacent the corresponding beverage container, and 2) determining the elapsed time between the activation and the deactivation of said tapping head.
23. The beverage dispensing system according to item 22, configured for determining the pouring volume of a tapping head operation by correlating the elapsed time between the activation and deactivation of said tapping head with a predefined and/or constant beverage flow rate in the system.

24. The beverage dispensing system according to any of the preceding items 9-23, configured for estimating the beverage flow rate by correlating with the change of the pressure in the sealed inner space during beverage dispensing.
25. The beverage dispensing system according to any of the preceding items 21-24, configured for determining the remaining volume of a collapsible beverage container by determining the pouring volume of each beverage tapping of said beverage container and correlating with the initial beverage volume of the beverage container.
26. The beverage dispensing system according to any of the preceding items 9-25, configured for detecting collapse of a specific beverage container by correlation with sound measured in or from the corresponding pressure chamber, such as a predefined sound pattern measured in or from the corresponding pressure chamber.
27. The beverage dispensing system according to any of the preceding items 9-26, configured for detecting the final collapse of a specific beverage container by correlation with sound measured in the corresponding pressure chamber, such as a predefined sound or sound pattern measured in or from the corresponding pressure chamber.
28. The beverage dispensing system according to any of the preceding items 9-27, configured for determining the emptying of a specific beverage container by detecting the final collapse of said beverage container.
29. The beverage dispensing system according to any of the preceding items, configured for calculating the first, second and/or third derivative of data from the measuring device such that changes in said at least one monitored property can be detected.
30. The beverage dispensing system according to any of the preceding items, wherein the tapping line comprises a plurality of beverage lines, each beverage line corresponding to a specific beverage type and adapted to cooperate with a tapping head of the tapping device, each tapping head corresponding to said beverage type.
31. The beverage dispensing system according to any of the preceding items, wherein the collapsible beverage containers are part of the system and wherein each of said collapsible beverage containers defines a beverage filled space, a gas-filled head space and a beverage outlet in communication with said beverage filled space for extracting said beverage from said beverage filled space.
32. The beverage dispensing system according to any of the preceding items, wherein each pressure chamber comprises a beverage container connector for connecting one of said tapping heads to the beverage outlet of the corresponding collapsible beverage container.
33. The beverage dispensing system according to any of the preceding items, wherein the system is configured for detecting sub-second changes in the measured physical quantity.
34. The beverage dispensing system according to any of the preceding items, wherein the system comprises at least two pressure chambers, each of said pressure chambers accommodating and encapsulating a collapsible beverage container.
35. A method for monitoring a beverage dispensing system, said beverage dispensing system comprising one or more pressure chambers, each pressure chamber defining a sealed inner space for accommodating and encapsulating a collapsible beverage container, a tapping device comprising one or more tapping heads for extracting the beverage from the collapsible beverage container(s), and a tapping line extending from the pressure chamber(s) to said tapping device, the method comprising the steps of:
measuring with at sampling rate of at least 10 Hz, preferably at least 50 Hz, at least one property of said pressure chamber, the corresponding sealed inner space, and/or the corresponding collapsible beverage container,
continuously analysing data representing said measured property, and
correlating a sub-second change in said measured property to an action in the beverage dispensing system.
36. The method according to item 35, wherein an action is selected from the group of: operation of a tapping head, operation of a specific tapping head, flow of beverage in the tapping line, flow of beverage in a specific beverage line.
37. The method according to item 35, comprising the step of detecting operation of a specific tapping head by correlation with a pressure change in the sealed inner space adjacent the corresponding beverage container.
38. A method for monitoring a beverage dispensing system, said beverage dispensing system comprising one or more pressure chambers, each pressure chamber defining a sealed inner space for accommodating and encapsulating a collapsible beverage container, a tapping device comprising one or more tapping heads for extracting the beverage from the collapsible beverage container(s), and a tapping line extending from the pressure chamber(s) to said tapping device, the method comprising the steps of:
continuously measuring the pressure of a gas contained in the sealed inner space using a measuring device with a sampling rate of at least 10 Hz,
continuously analysing the pressure data in order to detect sudden changes in pressure, and
correlating the change in pressure to an action in the beverage dispensing system.
39. A method for estimating the dispensed volume of a beverage dispensed from a beverage dispensing system, said beverage dispensing system comprising one or more pressure chambers, each pressure chamber defining a sealed inner space for accommodating and encapsulating a collapsible beverage container, a tapping device comprising one or more tapping heads for extracting the beverage from the collapsible beverage container(s), and a tapping line extending from the pressure chamber(s) to said tapping device, the method comprising the steps of
continuously measuring the pressure of a gas contained in the sealed inner space using a measuring device with a sampling rate of at least 10 Hz;
continuously analysing the pressure data in order to detect changes in pressure associated with the activation of a tapping head;
measuring the time elapsed between two such changes in pressure; and
estimating the dispensed volume of a beverage dispensed from the system by multiplying said time with the flow rate of the beverage in the tapping line.
40. The method according to any of items 39 or 40, wherein the measuring device is a pressure sensor.
41. The method according to item 39, wherein the pressure data is differentiated two times during the analysis step, and wherein the changes in pressure are detected by observing a peak in the second derivative of the pressure, said peak exceeding a predefined threshold value.
42. A method for monitoring a beverage dispensing system, said beverage dispensing system comprising one or more pressure chambers, each pressure chamber defining a sealed inner space for accommodating and encapsulating a collapsible beverage container, a tapping device comprising one or more tapping heads for extracting the beverage from the collapsible beverage container(s), and a tapping line extending from the pressure chamber(s) to said tapping device, the method comprising the steps of:

continuously measuring the pressure of a fluid in the tapping line;

continuously analysing the pressure data in order to detect changes in pressure associated with an event of the system;

correlating a pressure change with a certain event of the beverage dispensing system, wherein said pressure change exceeds a certain predefined threshold.

43. The method according to item 42, wherein the event relates to the emptiness of beverage container.

44. A beverage dispensing system for dispensing a beverage, said beverage dispensing system comprising:

one or more pressure chambers comprising a connectable base part and lid defining a sealed inner space for accommodating and encapsulating a collapsible beverage container having a beverage outlet connectable to the base part, a tapping device comprising one or more tapping heads for extracting the beverage from the collapsible beverage container(s), a tapping line extending from said base part(s) to said tapping device, said tapping line comprising one or more beverage lines, and at least one measuring device for each pressure chamber configured for monitoring at least one physical quantity of the corresponding sealed inner space, base part, lid and/or collapsible beverage container, said measuring device configured to have a sampling rate of at least 10 Hz, wherein the beverage dispensing system is configured for i. processing data from the measuring device(s), and ii. detecting an event in the system by continuously analysing data from the measuring device(s).

The beverage dispensing system according to item 44, wherein said measuring device comprises a pressure sensor configured for monitoring the pressure in the sealed inner space and/or in the tapping line.

45. The method according any of the preceding items 38-44, wherein the method is able to detect sub-second changes in pressure.

46. The method according any of the preceding items 38-45, wherein the operation of a specific tapping head may be determined based on said changes in pressure.

47. The method according any of the preceding items 38-46, wherein the change of state of the lid may be determined based on said changes in pressure.

48. The method according any of the preceding items 38-47, wherein the emptiness and/or collapse of a beverage container may be detected by analysing pressure changes of a fluid contained in the tapping line.

The invention claimed is:

1. A beverage dispensing system for dispensing a beverage, said beverage dispensing system comprising:

one or more pressure chambers comprising a connectable base part and lid defining a sealed inner space for accommodating and encapsulating a collapsible beverage container having a beverage outlet connectable to the base part, a tapping device comprising one or more tapping heads for extracting the beverage from the collapsible beverage container(s), a tapping line extending from said base part(s) to said tapping device, said tapping line comprising one or more beverage lines, and at least one measuring device configured for monitoring at least one physical quantity of the tapping line, sealed inner space, base part, lid and/or collapsible beverage container, said measuring device comprising an acceleration sensor configured for monitoring acceleration/movement of the base part, the lid and/or the corresponding collapsible beverage container, wherein the beverage dispensing system is configured for processing data from the measuring device(s), and detecting an event in the system by continuously analysing data from the measuring device(s) and distinguishing between different potential system events based on the data.

2. The beverage dispensing system according to claim 1, wherein said measuring device comprises a pressure sensor configured for monitoring a pressure in the sealed inner space and/or in the tapping line.

3. The beverage dispensing system according to claim 1, wherein said measuring device comprises an audio sensor configured for monitoring sound from the base part, the lid and/or the corresponding collapsible beverage container.

4. The beverage dispensing system according to claim 1, wherein the system comprises a processing unit for processing and/or analysing the data from the measuring device(s).

5. The beverage dispensing system according to claim 1, wherein the event is selected from the group of: operation of any of the one or more tapping heads, flow of beverage in the tapping line, flow of beverage in a specific beverage line, flow of gas in the tapping line, flow of gas in a specific beverage line, opening of a specific pressure chamber, operation of a pressurisation unit, collapsing of a specific collapsible beverage container, and final collapse of a specific collapsible beverage container.

6. The beverage dispensing system according to claim 1, configured for detecting a change in a measured physical quantity associated with a change in condition of the base part, the lid, the tapping line, and/or the sealed inner space adjacent the corresponding beverage container, wherein said detected change is a result of the event in the beverage dispensing system.

7. The beverage dispensing system according to claim 6, wherein a type of the event can be determined based on the detected change in the measured physical quantity.

8. The beverage dispensing system according to claim 6, wherein the event is operation of any of the one or more tapping heads.

9. The beverage dispensing system according to claim 6, configured for determining a pouring volume of a beverage dispensing operation in the system by attributing a pressure change in the tapping line and/or the inner space to the operation of a specific tapping head.

10. The beverage dispensing system according to claim 6, configured for 1) detecting activation and deactivation of a specific tapping head by detecting pressure changes in the tapping line and/or the sealed inner space adjacent the corresponding beverage container, and 2) determining the elapsed time between the activation and the deactivation of said tapping head.

11. The beverage dispensing system according to claim 1, configured for detecting a pressure change in the tapping line and/or in the sealed inner space adjacent the corresponding beverage container, wherein said pressure change is correlated with the operation of a specific tapping head.

12. The beverage dispensing system according to claim 1, configured for detecting operation of a tapping head by continuously measuring the pressure in the tapping line and/or in the sealed inner space adjacent the corresponding beverage container, detecting changes in the measured pressure, and analysing said changes in order to attribute said changes to the operation of a tapping head.

13. The beverage dispensing system according to claim 1, configured for detecting operation of a specific tapping head by detecting sound from collapse of the corresponding beverage container.

14. The beverage dispensing system according to claim 1, configured for determining an emptying of a specific beverage container by detecting a final collapse of said beverage container.

15. The beverage dispensing system according to claim 1, wherein the system comprises at least two pressure chambers, each of said pressure chambers accommodating and encapsulating a collapsible beverage container.

16. The beverage dispensing system according to claim 1, configured for determining a pouring volume of a beverage dispensing operation in the system wherein the beverage flow rate is considered constant.

17. The beverage dispensing system according to claim 1, wherein said measuring device is configured to have a sampling rate of at least 10 Hz.

18. A beverage dispensing system for dispensing a beverage, said beverage dispensing system comprising:

one or more pressure chambers comprising a connectable base part and lid defining a sealed inner space for accommodating and encapsulating a collapsible beverage container having a beverage outlet connectable to the base part, a tapping device comprising one or more tapping heads for extracting the beverage from the collapsible beverage container(s), a tapping line extending from said base part(s) to said tapping device, said tapping line comprising one or more beverage lines, and at least one measuring device configured for monitoring at least one physical quantity of the tapping line, sealed inner space, base part, lid and/or collapsible beverage container, said measuring device comprising an audio sensor configured for monitoring sound from the base part, the lid and/or the corresponding collapsible beverage container, wherein the beverage dispensing system is configured for processing data from the measuring device(s), and detecting an event in the system by continuously analysing data from the measuring device(s) and distinguishing between different potential system events based on the data.

19. A beverage dispensing system for dispensing a beverage, said beverage dispensing system comprising:

one or more pressure chambers comprising a connectable base part and lid defining a sealed inner space for accommodating and encapsulating a collapsible beverage container having a beverage outlet connectable to the base part, a tapping device comprising one or more tapping heads for extracting the beverage from the collapsible beverage container(s), a tapping line extending from said base part(s) to said tapping device, said tapping line comprising one or more beverage lines, and at least one measuring device configured for monitoring at least one physical quantity of the tapping line, sealed inner space, base part, lid and/or collapsible beverage container, wherein the beverage dispensing system is configured for processing data from the measuring device(s), detecting an event in the system by continuously analysing data from the measuring device(s) and distinguishing between different potential system events based on the data, and detecting a change in a measured physical quantity associated with a change in condition of the base part, the lid, the tapping line, and/or the sealed inner space adjacent the corresponding beverage container, wherein said detected change is a result of the event in the beverage dispensing system, wherein the beverage system is further configured for 1) detecting activation and deactivation of a specific tapping head by detecting pressure changes in the tapping line and/or the sealed inner space adjacent the corresponding beverage container, and 2) determining the elapsed time between the activation and the deactivation of said tapping head.

20. A beverage dispensing system for dispensing a beverage, said beverage dispensing system comprising:

one or more pressure chambers comprising a connectable base part and lid defining a sealed inner space for accommodating and encapsulating a collapsible beverage container having a beverage outlet connectable to the base part, a tapping device comprising one or more tapping heads for extracting the beverage from the collapsible beverage container(s), a tapping line extending from said base part(s) to said tapping device, said tapping line comprising one or more beverage lines, and at least one measuring device configured for monitoring at least one physical quantity of the tapping line, sealed inner space, base part, lid and/or collapsible beverage container, wherein the beverage dispensing system is configured for processing data from the measuring device(s), detecting an event in the system by continuously analysing data from the measuring device(s) and distinguishing between different potential system events based on the data, and detecting operation of a specific tapping head by detecting sound from collapse of the corresponding beverage container.

* * * * *